US007730896B2

(12) United States Patent
Okamoto et al.

(10) Patent No.: US 7,730,896 B2
(45) Date of Patent: Jun. 8, 2010

(54) DRY CLEANING DEVICE AND DRY CLEANING METHOD

(75) Inventors: Yoichi Okamoto, Kanagawa (JP); Yuusuke Taneda, Kanagawa (JP); Akihiro Fuchigami, Kanagawa (JP); Tatsuya Satoh, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 464 days.

(21) Appl. No.: 11/896,019

(22) Filed: Aug. 29, 2007

(65) Prior Publication Data

US 2008/0052953 A1 Mar. 6, 2008

(30) Foreign Application Priority Data

Sep. 6, 2006 (JP) ..... 2006-240920
Sep. 6, 2006 (JP) ..... 2006-240948
Sep. 6, 2006 (JP) ..... 2006-240971

(51) Int. Cl.
*B08B 13/00* (2006.01)

(52) U.S. Cl. ..... 134/93; 134/104.2

(58) Field of Classification Search ..... None
See application file for complete search history.

(56) References Cited

U.S. PATENT DOCUMENTS 6,034,351 A * 3/2000 Sato et al. ..... 219/136
2007/0107752 A1 5/2007 Fuchigami et al.

FOREIGN PATENT DOCUMENTS

| | | |
|---|---|---|
| EP | 1 782 895 | 5/2007 |
| JP | 06-254522 | 9/1994 |
| JP | 10-034100 | 2/1998 |
| JP | 10-202528 | 8/1998 |
| JP | 2005-182168 | 7/2005 |
| JP | 2005-329292 | 12/2005 |
| JP | 2006-169124 | 6/2006 |
| WO | WO 2006/075791 | 7/2006 |

OTHER PUBLICATIONS

Office Action dated Jan. 14, 2009 for corresponding Korean Application No. 10-2007-0089964 and English translation thereof.

* cited by examiner

*Primary Examiner*—Michael Kornakov
*Assistant Examiner*—Ryan Coleman
(74) *Attorney, Agent, or Firm*—Harness, Dickey & Pierce, P.L.C.

(57) ABSTRACT

A circulation-air generating unit directly generates circulation air that flows along a surface of a cleaning tank. The circulation air is applied to cleaning medium accumulated on the cleaning tank from a direction orthogonal to a direction of face of the cleaning medium to deliver and flow up the cleaning medium. The cleaning medium is flown up inside the cleaning tank by the force of the circulation air. The cleaning medium flowing inside the cleaning tank collides with a cleaning target object by high-velocity air supplied from a cleaning-medium accelerating unit to remove dust on the cleaning target object.

19 Claims, 19 Drawing Sheets

| θ | CIRCULATION |
|---|---|
| 30° | BAD |
| 45° | BAD |
| 60° | BAD |
| 75° | MODEST |
| 90° | MODEST |
| 105° | MODEST |
| 120° | GOOD |
| 135° | GOOD |
| 150° | GOOD |

DRY CLEANING DEVICE AND DRY CLEANING METHOD

CROSS-REFERENCE TO RELATED APPLICATIONS

The present application claims priority to and incorporates by reference the entire contents of Japanese priority documents, 2006-240920 filed in Japan on Sep. 6, 2006, 2006-240948 filed in Japan on Sep. 6, 2006 and 2006-240971 filed in Japan on Sep. 6, 2006.

BACKGROUND OF THE INVENTION

1. Field of the Invention

The present invention generally relates to an image forming apparatus, and specifically relates to a technology for performing dry cleaning of components used in an image forming apparatus.

2. Description of the Related Art

Recently, manufactures of office equipments, such as copying machines, facsimile machines, and printers, have been proactively making recycling activities to create a resource recycling society. Such recycling activities include collecting used products from users, disassembling, cleaning, and reassembling the products, and reusing the products themselves or certain components of the products. In the case of image forming apparatuses, such as copying machines, facsimile machines, and printers, toner, which is a very fine powder, generally inevitably adheres to the components inside the image forming apparatuses. When recycling the image forming apparatuses itself or the components thereof, it is necessary to clean the toner.

Some conventional methods, i.e., wet cleaning methods, use water or solvent for cleaning the toner. However, in such methods, there is a problem of increase of energy consumption, environmental burdens, and costs because of processes necessary for disposing effluent that contains toner and for drying the components after the cleaning is finished.

Some other conventional methods, i.e., dry cleaning methods, use air blow for cleaning the toner. However, because cleaning performance is not sufficient for removing toner attached with strong adhesive force, an extra process is necessary for manually removing toner using a cloth or the like. Thus, the cleaning process is considered as one of bottleneck processes in a product reusing/recycling process.

Some still other conventional methods, i.e., blast cleaning methods, use dry ice for the toner. However, these methods have higher running costs and they put a lot of burden on the environment because they use a large amount of dry ice.

For counteracting above problems, Japanese Patent No. 3288462 discloses a dry cleaning device that removes dust attached to a cleaning target object. In this technology, the dry cleaning device agitates an electrified cleaning target object with an elastically flexible contact member in a rotating cylinder to neutralize the cleaning target object, so that adhesive force of the dust can be weakened, and the dust can be removed from the cleaning target object. However, it is difficult to remove dust with strong adhesive force because contact force between the contact member and the cleaning target object due to agitation is not sufficient.

Furthermore, Japanese Patent No. 2889547 discloses a technology for removing attachment from a cleaning target object by blowing particles finely cut from a small sphere or a wire rod made of steel, aluminum or stainless to the cleaning target object. Moreover, Japanese Patent No. 3468995 discloses a technology for a shot blast method of removing dust and dirt from a container made of resin by blowing high-velocity air containing particulate solids to a surface of the container.

Furthermore, Japanese Patent Application Laid-Open No. 2005-329292 discloses a dry cleaning method of removing attachment from a cleaning target object. In the dry cleaning method, a particulate cleaning medium that adsorbs fine particles is introduced into a cleaning target container, and a cleaning nozzle is put into an opening portion of the cleaning target container. High-velocity air is injected into the cleaning target container and discharged from the cleaning nozzle to blow up the cleaning medium inside the cleaning target container. The cleaning medium that has been blown up removes particles attached to internal surfaces of the cleaning target container. Subsequently, the cleaning medium collides with a mesh portion at an end portion of the cleaning nozzle, so that fine particles adsorbed on the cleaning medium is removed and filtered to make it possible to reuse the cleaning medium. Recycled cleaning medium is re-blown up by air to repeatedly clean the cleaning target container.

However, in the dry cleaning device disclosed in the Japanese Patent No. 3288462, the contact force between the contact member and the cleaning target object due to agitation is not sufficient. Therefore, it is difficult to remove dust attached with strong adhesive force.

Furthermore, in the shot blast method disclosed in the Japanese Patents No. 2889547 and No. 3468995, because a small piece or a particulate solid finely cut from a metal small sphere or a wire rod is used, a surface of the cleaning target object is scratched and scrubbed, making the surface rough during a process of removing dust from the cleaning target object. Therefore, the shot blast method is not suitable when it is not allowed to scratch the cleaning target object.

Moreover, in the dry cleaning device disclosed in the Japanese Patent Application Laid-Open No. 2005-329292, processes of flowing up the cleaning medium and recycling the cleaning medium by adsorption are simultaneously performed, which is effective for a small-sized container. However, for a large-sized cleaning tank in which a cleaning target is introduced and moved for cleaning, there is a possibility that the cleaning medium is accumulated without being flown up in the cleaning tank, causing stagnation flow of the cleaning medium, because energy for flowing up the cleaning medium is dispersed. Therefore, it is difficult to sufficiently flow up and recycle the cleaning medium in the large-sized cleaning tank, resulting in degrading cleaning performance.

SUMMARY OF THE INVENTION

It is an object of the present invention to at least partially solve the problems in the conventional technology.

According to an aspect of the present invention, there is provided a dry cleaning device including a circulation-air generating unit that generates high-velocity air inside a cleaning tank to flow up flexible flaked-shaped cleaning medium present in the cleaning tank; a cleaning-medium accelerating unit that accelerates the cleaning medium flowing in the cleaning tank so that the cleaning medium collides with a cleaning target object thereby separating particles sticking onto the cleaning target object; and a cleaning-medium recycle unit that sucks the particles separated from the cleaning target object and recycles the cleaning medium.

According to another aspect of the present invention, there is provided a dry cleaning method including delivering a flaked-shaped flexible cleaning media accumulated on a surface of a cleaning tank, by circulation air flowing along surfaces of the cleaning tank; flowing up the flaked-shaped flexible cleaning media delivered at the delivering in the cleaning tank; causing the cleaning media flown at the flowing up to collide with a cleaning target object by high-velocity air; and removing particles sticking to the cleaning target object.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 1:
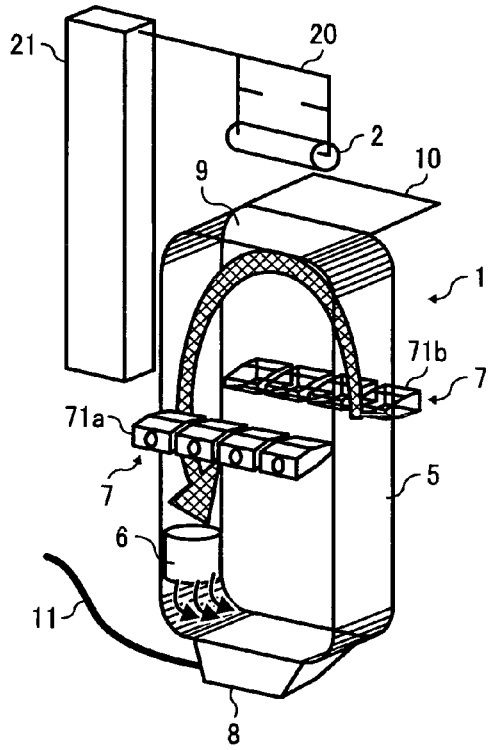
FIG. 1 is a schematic diagram of a dry cleaning device according to a first embodiment of the present invention.
Figure 2A:
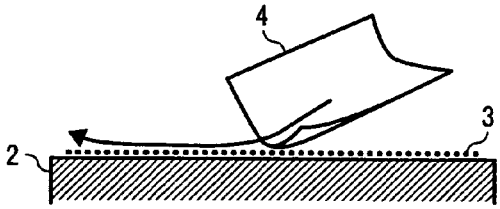
FIGS. 2A and 2B are schematic diagrams for explaining a process of removing dust from a cleaning target object shown in FIG. 1 by a flake-shaped cleaning medium.
Figure 2B:
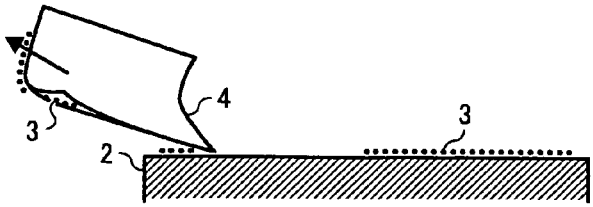

FIG. 1 is a schematic diagram of a dry cleaning device 1 according to a first embodiment of the present invention. The dry cleaning device 1 removes various dusts 3, such as toner, attached to a cleaning target object 2 by using a cleaning medium 4 flown by high-velocity air as shown in FIG. 2. The dry cleaning device 1 includes a cleaning tank 5, a circulation-air generating unit 6, a cleaning-medium accelerating unit 7, and a cleaning-medium recycle unit 8.

The cleaning medium 4 used in the dry cleaning device 1 can be formed in one of granular shape, stick shape, tubular shape, fibriform, flaked shape, and the like, which is made of one of metals, ceramics, synthetic resin, sponge, fabric, and the like. A shape and material of the cleaning medium 4 can be determined depending on characteristics of a shape and material of the cleaning target object 2 or a particle size or attachment strength of the dust 3 attached to the cleaning target object 2. As for the cleaning medium 4 in a flaked shape, a preferable size is such that its area is in a range between 1 square millimeter ($mm^2$) and 1000 $mm^2$, and its thickness is in a range between 1 micrometer (μm) and 500 μm. For example, for removing, from a component made of synthetic resin or metal, toner particle having an average diameter of 5 μm to 10 μm, which is used for an electrophotographic image forming apparatus, it is preferable to use the cleaning medium 4 made of resin film, paper, or metal flake, in a flaked-shape.

When the cleaning medium 4 is in a flaked shape, when the cleaning medium 4 collides with the cleaning target object 2 at an edge portion of the cleaning medium 4, contact force is concentrated on the edge portion, enabling the cleaning medium 4 to obtain force necessary for removing the dust 3 even though mass of the cleaning medium 4 is small. Because the cleaning medium 4 gets bent and loses applied force when the contact force to the cleaning target object 2 increases, unwanted extra force is not applied to the cleaning target object 2. Accordingly, the cleaning target object 2 hardly gets damaged unlike a general blast shot material or an abrasive for barell finishing. Furthermore, inelastic collision occurs between the flaked-shaped cleaning medium 4 and the cleaning target object 2 largely due to viscous drag of air applied when the cleaning medium 4 is bent caused by collision with the cleaning target object 2. Therefore, the cleaning medium 4 is hardly bounced. When oblique collision occurs between the cleaning medium 4 and the cleaning target object 2, the cleaning medium 4 slides across a surface of the cleaning target object 2, contacting a wide area of the surface by a single collision. Due to scratching action or scrubbing action caused by the contact, a parallel force is applied to a contact surface of the dust 3 attached to the cleaning target object 2. As a result, it is possible to remove the dust 3 from the cleaning target object 2 with small force, increasing cleaning efficiency.

Figure 3A:
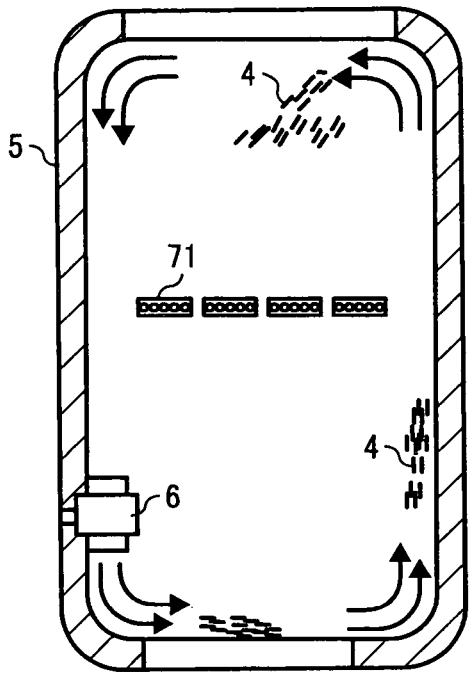
FIGS. 3A and 3B are cross sections of a cleaning tank shown in FIG. 1.
Figure 3B:
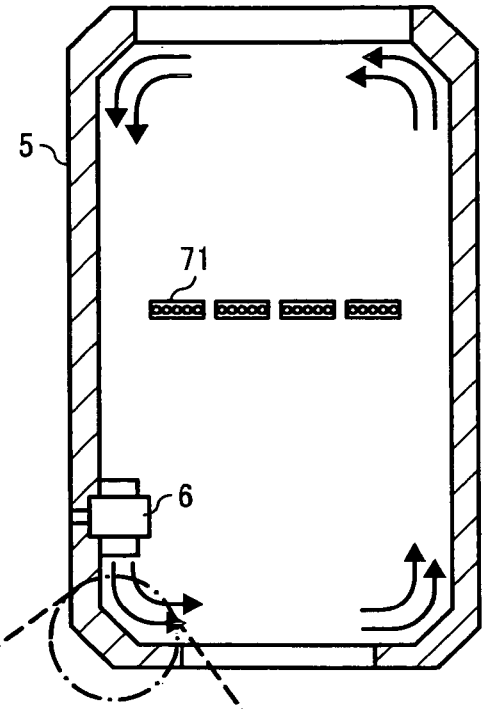
Figure 3B:
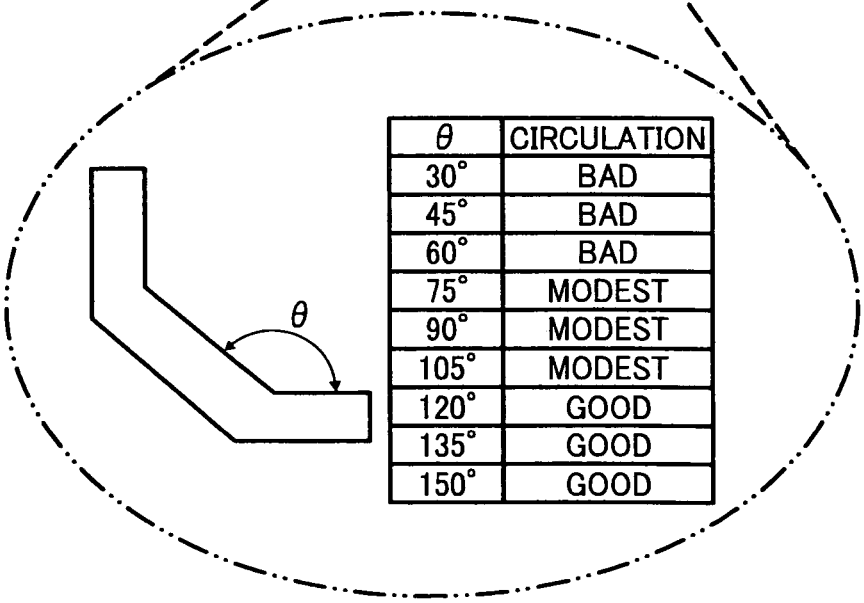
Figure 4:
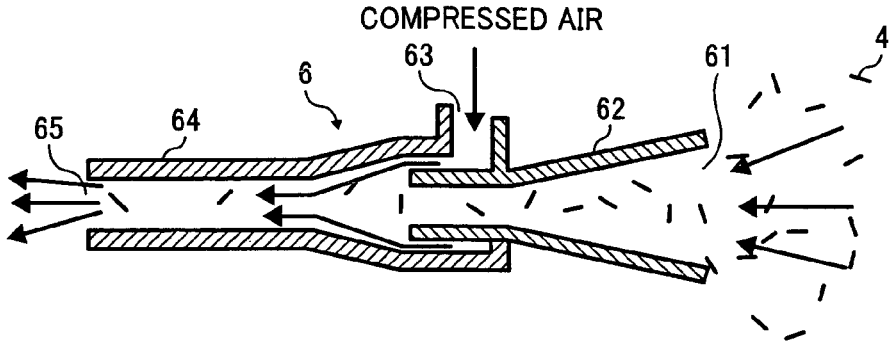
FIG. 4 is a cross section of a circulation-air generating unit shown in FIG. 1.

The cleaning tank 5 is formed in substantially rectangular solid with a hollow body, and includes a cleaning-target loading port 9 on its top surface for loading the cleaning target object 2, an opening portion on its bottom portion, a cover 10, which can be flexibly opened and closed, on the cleaning-target loading port 9, and the cleaning-medium recycle unit 8 at an opening portion of its bottom portion. On a portion of an internal surface of one side surface of the cleaning tank 5, the circulation-air generating unit 6 is arranged as shown in FIG. 3, forming a circulation path of circulation air on internal surfaces of both side surfaces, the bottom surface, and the top surface of the cleaning tank 5. Each of corner portions of the internal surfaces constituting the circulation path is formed in R shape as shown in FIG. 3A, or with a predetermined angle θ between each of the side surfaces, the top surface, and the bottom surface as shown in FIG. 3B, so that circulation air can be effectively circulated. The predetermined angle θ is preferably determined between 120° and 150° for circulating the circulation air with less resistance.

As described above, each of the corner portions of the internal surfaces with the circulation path is formed in a circular shape or with a predetermined angle between each of adjacent side surfaces. Therefore, the cleaning medium can be delivered without colliding with the internal surfaces. As a result, it is possible to effectively deliver the cleaning medium, increasing cleaning efficiency, and to deliver the cleaning medium with less air supplied, realizing energy saving.

The circulation-air generating unit 6 includes an inlet portion 62 having an inlet opening 61 with a large diameter, and an outlet portion 64 having a compressed-air supply opening 63 arranged on a periphery of an outlet side of the inlet portion 62. The circulation-air generating unit 6 inlets air from the inlet portion 62 by high-velocity airflow supplied from the compressed-air supply opening 63 generated toward an outlet opening 65 of the outlet portion 64, and outlets air with amount of several times to dozens of times of amount of compressed air supplied from the compressed-air supply opening 63. By using the circulation-air generating unit 6, it is possible to circulate the cleaning medium with less energy, reducing amount of the compressed air to be consumed, compared to a case using a general air-blow nozzle. Furthermore, it is possible to easily maintain negative pressure inside the cleaning tank 5 and to prevent leakage of the dusts outside the cleaning tank 5. Various gasses, such as nitride gas, carbon dioxide gas, inactive gas including argon gas, instead of the compressed air, can be supplied from the compressed-air supply opening 63. In the embodiments described below, cases employing the compressed air are explained. The circulation-air generating unit 6 is arranged on a side surface constituting the circulation path near the bottom portion of the cleaning tank 5, with the inlet opening 61 side up while the outlet opening 65 side down.

The cleaning-medium accelerating unit 7 includes a plurality of acceleration nozzles 71*a* arrayed on a front surface orthogonal to an internal surface constituting the circulation path, and a plurality of acceleration nozzles 71*b* arrayed on a back surface facing the front surface with the acceleration nozzles 71*a* arranged. The cleaning-medium accelerating unit 7 blowouts compressed air supplied from a compressed-air source, such as a compressor and a compression tank, inside the cleaning tank 5 via each of the acceleration nozzles 71*a* and 71*b* to cause the cleaning medium 4 to collide with the cleaning target object 2. It is preferable to use a blowout nozzle, like the circulation-air generating unit 6, for the acceleration nozzles 71*a* and 71*b*.

With the cleaning-medium accelerating unit 7 arranged on a surface orthogonal to the surface constituting the circulation path of the circulation air inside the cleaning tank, and with the nozzle of the cleaning-medium accelerating unit 7 embedded inside the surface of the cleaning tank, it is possible to avoid interference in circulation of the circulation air and effectively cause the cleaning medium to collide with the cleaning target object.

Figure 5A:
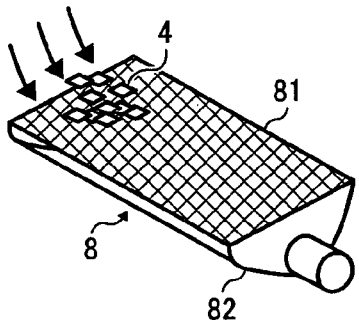
FIGS. 5A and 5B are schematic diagrams of a cleaning-medium recycle unit shown in FIG. 1.
Figure 5B:
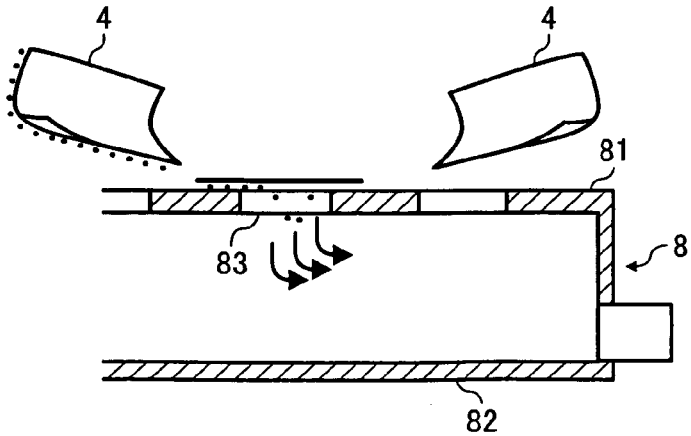

The cleaning-medium recycle unit 8 includes a separation member 81 and a hood 82 arranged on an internal surface of the bottom portion of the cleaning tank 5, forming a closed space as shown in a perspective view of FIG. 5A and a partial cross section of FIG. 5B. The closed space is connected to a dust collector (not shown) including a negative-pressure generating source via a suction tube 11, such as a hose, to generate negative pressure in the hood 82. The separation member 81 includes a plurality of small poles and slits 83 in a size through which air and particles can pass while the cleaning medium 4 cannot pass, and are made of porous member, such as metal, plastic mesh, mesh, punched metal plate, and slit plate. With this configuration, the separation member 81 removes dust removed from the cleaning target object 2, and eliminates the cleaning medium 4 worn and chipped by collision with the cleaning target object 2, or the cleaning medium 4 with degraded elasticity due to long-term use.

As described above, dust and the like attached to the cleaning medium is removed by adsorption by the cleaning-medium recycle unit, so that it is possible to maintain a cleanness of the cleaning medium. Therefore, it is possible to maintain high quality in cleaning, and the cleaning medium can be used repeatedly, resulting in realizing a cleaning with low environmental burdens.

By arranging the cleaning-medium recycle unit at the bottom portion of the cleaning tank, it is possible to increase possibility that the cleaning medium, which has been fallen down the bottom portion of the cleaning tank by gravitation, passes through the cleaning-medium recycle unit, increasing efficiency of recycling the cleaning medium. As a result, the cleanness of the cleaning medium can be improved, improving quality in cleaning.

Figure 6:
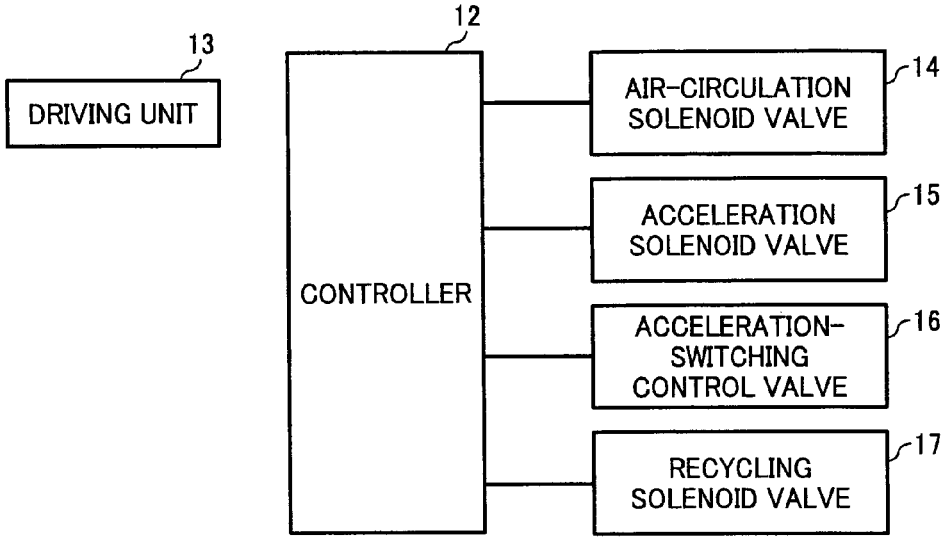
FIG. 6 is a block diagram of a drive control unit of the dry cleaning device shown in FIG. 1.
Figure 7A:
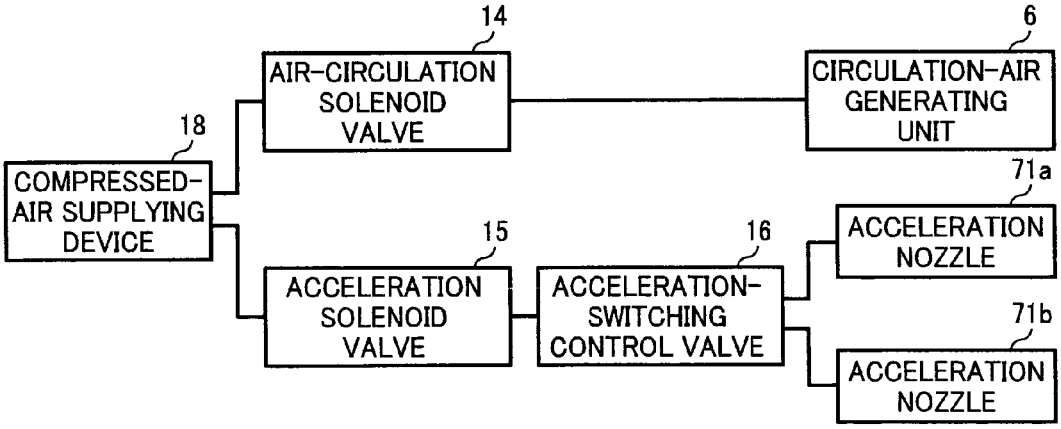
FIGS. 7A and 7B are block diagrams of a driving unit of the dry cleaning device shown in FIG. 1.
Figure 7B:
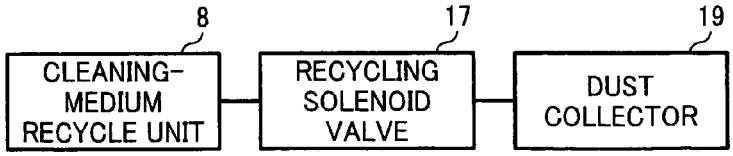

A controller 12 of the dry cleaning device 1 includes an air-circulation solenoid valve 14, an acceleration solenoid valve 15, an acceleration-switching control valve 16, and a recycling solenoid valve 17, which are connected to the controller 12 with one another, and controls each of the solenoid valves by a drive signal from a driving unit 13, as shown in a block diagram of FIG. 6 and pipeline diagrams shown in FIGS. 7A and 7B. The air-circulation solenoid valve 14 performs conduction and non-conduction of an air pipe for supplying compressed air from a compressed-air supplying device 18 to the circulation-air generating unit 6. The acceleration solenoid valve 15 performs conduction and non-conduction of an air pipe for supplying compressed air to the cleaning-medium accelerating unit 7. The acceleration-switching control valve 16 switches directions of flow of compressed air to be supplied to the acceleration nozzles 71*a* and 71*b* respectively arranged on side surfaces of the cleaning-medium accelerating unit 7. The recycling solenoid valve 17 performs conduction and non-conduction of the suction tube 11 connecting the cleaning-medium recycle unit 8 to a dust collector 19.

Figure 8:
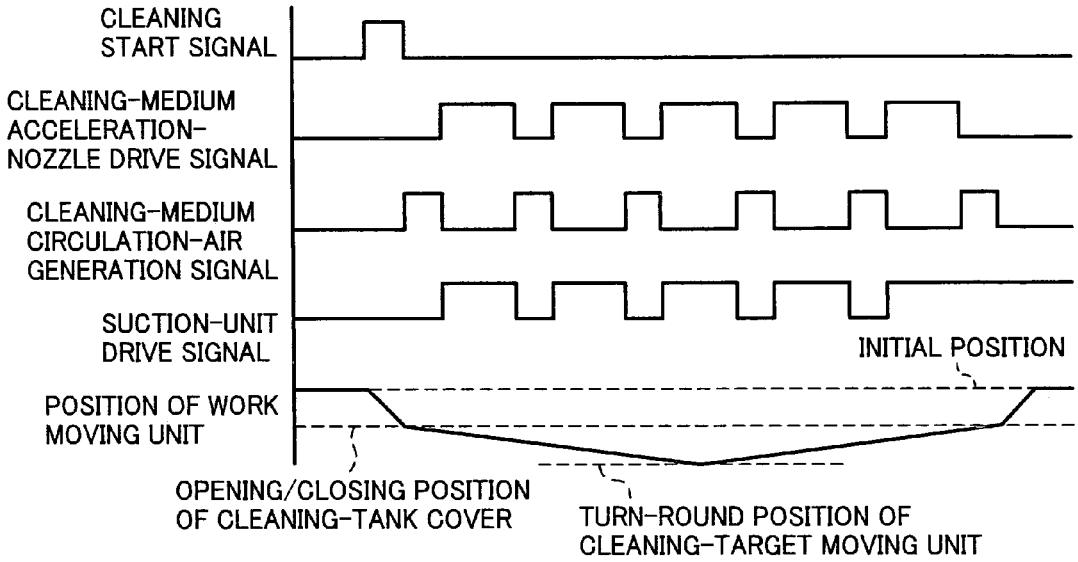
FIG. 8 is a timechart of a cleaning operation performed by the dry cleaning device shown in FIG. 1.

An operation is explained below with reference to a time-chart shown in FIG. 8, of removing the dust 3 attached to the cleaning target object 2 by loading the cleaning target object 2 held by a work holding unit 20 into the cleaning tank 5 by a work moving unit 21 in the dry cleaning device 1.

Figure 9A:
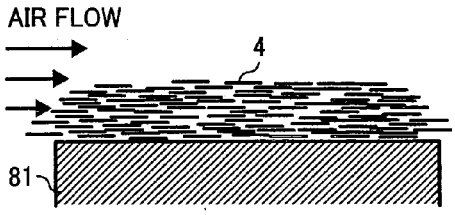
FIGS. 9A to 9C are schematic diagrams for explaining a state of delivery, by circulation air, of cleaning media accumulated on the cleaning-medium recycle unit shown in FIG. 1.
Figure 9B:
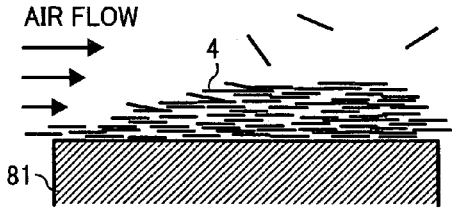
Figure 9C:
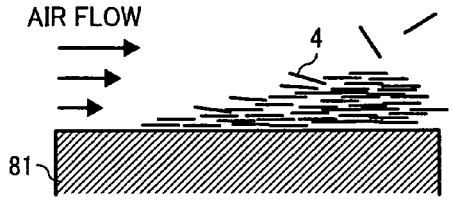

The flaked-shaped cleaning medium 4 is introduced into the cleaning tank 5 and accumulated on the separation member 81 of the cleaning-medium recycle unit 8. Subsequently, the cleaning target object 2 held by the work holding unit 20 is loaded from the cleaning-target loading port 9 by the work moving unit 21 and set at an initial position. The cover 10 is closed to seal off the cleaning tank 5. Upon receiving a cleaning start signal by an operation of the driving unit 13, the controller 12 opens the air-circulation solenoid valve 14 and supplies compressed air to the circulation-air generating unit 6 from the compressed-air supplying device 18, such as a compressor, so that the circulation-air generating unit 6 generates circulation air that flows along the circulation path arranged on the internal surfaces of the cleaning tank 5. The circulation air flows along the separation member 81, so that the circulation air acts on the flaked-shaped cleaning medium 4 accumulated on the separation member 81 from a longitudinal direction as shown in FIG. 9A, and gradually chips away accumulation of the cleaning medium 4 from an upper portion of the accumulation. As a result, the cleaning medium 4 is delivered and flown up in the cleaning tank 5 as shown in FIGS. 9B and 9C. Because the circulation air for flowing up the cleaning medium 4 is directly blown from the circulation-air generating unit 6 into the cleaning tank 5, large impact force can be applied to the accumulated cleaning medium 4. Therefore, it is possible to assuredly flow up the accumulated cleaning medium 4 by the circulation air.

As descried above, the circulation-air generating unit generates the circulation air that flows along the surface of the cleaning medium accumulated on the cleaning-medium recycle unit. Therefore, it is possible to apply large force for flowing up the accumulated cleaning medium to a large amount of the cleaning media, and circulate the cleaning medium along the internal surfaces of the cleaning tank. As a result, cleaning efficiency can be improved.

In other words, by flowing the circulation air generated by the circulation-air generating unit along the cleaning-medium recycle unit, it is possible to assuredly remove, from the cleaning-medium recycle unit, the cleaning medium stuck to the cleaning-medium recycle unit, and deliver the cleaning medium in the cleaning tank. Furthermore, it is possible to maintain performance of the cleaning-medium recycle unit, of recycling the cleaning medium.

Moreover, by generating the circulation air from the circulation-air generating unit along the longitudinal direction of the cleaning tank, the circulation air is not dispersed and its force is not lost upon flowing. Therefore, it is possible to effectively apply the force of the circulation air to the cleaning medium accumulated on the bottom portion of the cleaning tank. Furthermore, it is possible to deliver and flow up the cleaning medium even with small number of the circulation-air generating units and small amount of air supplied to the circulation-air generating unit. As a result, it is possible to suppress amount of energy necessary for cleaning.

Figure 10A:
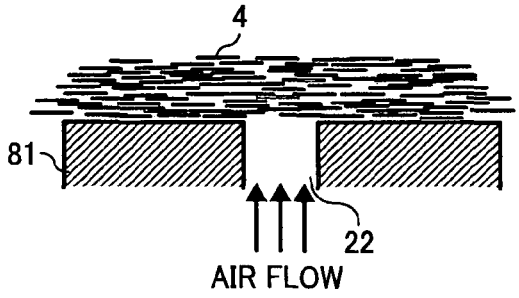
FIGS. 10A to 10C are schematic diagrams for explaining another state of delivery, by circulation air, of cleaning media accumulated on the cleaning-medium recycle unit shown in FIG. 1.
Figure 10B:
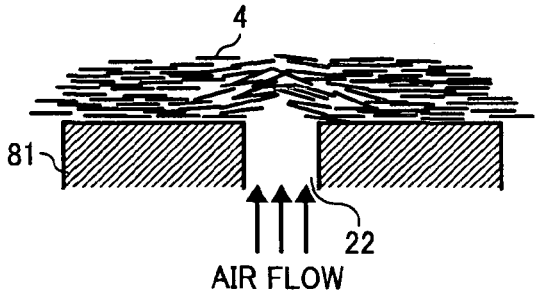
Figure 10C:
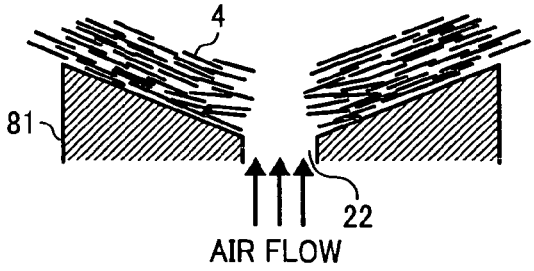

For delivering and flowing up the accumulated flaked-shaped cleaning medium 4 by air as described above, when the air is applied in a direction orthogonal to a longitudinal direction of the accumulated cleaning medium 4 by a nozzle 22 to the flaked-shaped cleaning medium 4 accumulated on the separation member 81 as shown in FIG. 10A, it is necessary to supply compressed air with energy sufficient for flowing up entire portion of the cleaning medium 4 where the compressed air is applied. Accordingly, as shown in FIG. 10B, it becomes difficult to flow the cleaning medium 4 as accumulation amount of the cleaning medium 4 increases. In addition, although it is possible to flow up the cleaning medium 4 accumulated on a portion right over the nozzle 22 that outputs air, because flowability of the accumulated flaked-shaped cleaning medium 4 is low, it is difficult to flow up entire portion of the accumulated cleaning medium 4 even when the separation member 81 is inclined toward the nozzle 22 as shown in FIG. 10C. As a result, the cleaning medium accumulated on a portion around the nozzle 22 is left without being flown up. On the contrary, when air is applied from a longitudinal direction of the cleaning medium 4 accumulated on the separation member 81 by generating, by the circulation-air generating unit 6, circulation air that flows along the circulation path on the internal surface of the cleaning tank 5, it is possible to assuredly flow up the cleaning medium 4 with less energy. As a result, it is possible to reduce consumption of the amount of compressed air supplied to the circulation-air generating unit 6. If the cleaning medium 4 is delivered by air using a duct or a hose, the cleaning medium 4 may be clogged in the duct or the hose. However, the circulation path of the circulation air is formed on the internal surfaces of the cleaning tank 5 in the first embodiment, it is possible to avoid clogging the cleaning medium 4 in the circulation path, resulting in flowing up the cleaning medium 4 in the cleaning tank 5.

According to the embodiments, circulation air for delivering and flowing up the flaked-shaped flexible cleaning medium flows along the internal surfaces of the cleaning tank, so that the circulation air is not dispersed and its force is not lost. Therefore, it is possible to effectively apply force of the circulation air to the cleaning medium accumulated on the cleaning tank, delivering and flowing up a large amount of the cleaning media with less amount of air supplied. As a result, energy consumption necessary for cleaning can be suppressed. Furthermore, even when once-removed dust is re-attached to the internal surfaces of the cleaning tank, the internal surfaces can be continuously cleaned because a large amount of the cleaning media is circulating. Therefore, it is possible to reduce operations in maintenance, such as cleaning, of the cleaning tank.

The circulation-air generating unit 6 that generates circulation air is arranged with the inlet opening 61 side up and the outlet opening 65 side down, around the bottom portion of a side surface constituting the circulation path in the cleaning tank 5. Therefore, it is possible to apply air with strong force to the cleaning medium 4 accumulated on the separation member 81 on the bottom portion of the cleaning tank 5, along a bottom surface of the cleaning tank 5. As a result, it is possible to deliver the cleaning medium 4 along the internal surfaces of the cleaning tank 5 to an area away from the outlet opening 65. In addition, the cleaning media 4 introduced into the inlet opening 61 are dispersed, reducing space density. Therefore, the cleaning medium 4 hardly clogs the inlet opening 61, resulting in stably generating the circulation air. In other words, when the inlet opening 61 is arranged around the bottom portion of the cleaning tank with its opening side down, the force of suction air is exclusively applied to the cleaning medium 4 around the inlet opening 61. Therefore, it is difficult to deliver large amounts of the cleaning media 4 accumulated on the bottom portion of the cleaning tank 5. In addition, when large amounts of the accumulated cleaning media 4 are adsorbed by the inlet opening 61, space density in the inlet opening 61 increases by the cleaning media 4. Therefore, the inlet opening 61 is clogged. However, with the configuration described in the first embodiment, it is possible to avoid such problems.

The controller 12 closes the air-circulation solenoid valve 14 when a predetermined time elapsed, and causes the circulation-air generating unit 6 to stop generating the circulation air. Subsequently, the controller 12 causes the work moving unit 21 to move down the cleaning target object 2 from the initial position, opens the acceleration solenoid valve 15 to supply compressed air to the cleaning-medium accelerating unit 7 via the acceleration-switching control valve 16, so that compressed air is blown out from the acceleration nozzle 71*a* of the cleaning-medium accelerating unit 7. The controller 12 opens the recycling solenoid valve 17 to conduct the cleaning-medium recycle unit 8 to the dust collector 19, and generates negative pressure in the hood 82. When the circulation air generated by the circulation-air generating unit 6 is stopped, the cleaning medium 4 flown by the circulation air is fallen down. The falling down cleaning medium 4 is caused to collide with the cleaning target object 2 by the compressed air blown from the acceleration nozzle 71*a*, removing the dust 3 attached to a surface of the cleaning target object 2.

The dust 3 removed from the cleaning target object 2 and the cleaning medium 4 with the dust attached due to collision with the cleaning target object 2 are fallen by gravity, and accumulated on the separation member 81 of the cleaning-medium recycle unit 8 that is vacuuming air due to the negative pressure inside the hood 82. The dust fallen on the separation member 81 and the dust attached to the cleaning medium 4 are vacuumed into the hood 82 due to the negative pressure inside the hood 82, and collected by the dust collector 19. As a result, the cleaning medium 4 with the dust attached can be effectively recycled.

Upon blowing compressed air from the acceleration nozzle 71*a* for a predetermined time period, the controller 12 closes the acceleration solenoid valve 15 and the recycling solenoid valve 17, and stops operations of the cleaning-medium accelerating unit 7 and the cleaning-medium recycle unit 8. When the recycling solenoid valve 17 is closed, the negative pressure inside the hood 82 is released, so that vacuum force of the hood 82 to the cleaning medium 4 accumulated on the separation member 81 is lost. Therefore, the cleaning medium 4 is removed from the separation member 81 by subsequent flow of the circulation air. Accordingly, the dust can be continuously removed from the cleaning medium 4 without causing the cleaning medium 4 to cover and seal a mesh portion of the separation member 81. Therefore, it is not required to replace all the cleaning media 4, making it possible to effectively use the cleaning medium 4 by supplying deficient amounts due to damage. As a result, maintenance efficiency can be improved.

As described above, by intermittently operating the cleaning-medium recycle unit, it is possible to remove, from the cleaning-medium recycle unit, the cleaning medium stuck to the cleaning-medium recycle unit. Therefore, performance of the cleaning-medium recycle unit can be maintained.

It is difficult for the cleaning medium to move when the cleaning-medium recycle unit is vacuuming the cleaning medium for recycling because retaining force is applied to the cleaning medium. However, because the cleaning medium is not recycled during circulation of the cleaning medium according to the first embodiment, it is possible to realize effective circulation of the cleaning medium. As a result, it is possible to load a large number of the cleaning media to the cleaning-medium accelerating unit, improving cleaning efficiency.

The controller 12 re-opens the air-circulation solenoid valve 14 to cause the circulation-air generating unit 6 to generate circulation air, flows the cleaning medium 4 recycled and accumulated on the separation member 81 of the cleaning-medium recycle unit 8 for a predetermined time period T1. Subsequently, the controller 12 opens the acceleration solenoid valve 15 and the recycling solenoid valve 17 to switch the acceleration-switching control valve 16 to the acceleration nozzle 71*b*, and performs a process of removing dust from the cleaning target object 2 and a process of recycling the cleaning medium 4 for a predetermined time period. The time for performing the processes of removing dust from the cleaning target object 2 and recycling the cleaning medium 4 are set longer than a time for generating the circulation air, so that wide range of the cleaning target object 2 can be cleaned. Because compressed air is blown out alternately from each of the acceleration nozzles 71*a* and 71*b*, it is possible to avoid interference between air blown out from each of the acceleration nozzles 71*a* and 71*b*. Therefore, it is possible to assuredly cause the cleaning medium 4 to collide with the cleaning target object 2. As a result, cleaning efficiency of the cleaning medium 4 can be improved.

Figures 11A, 11B, 11C:
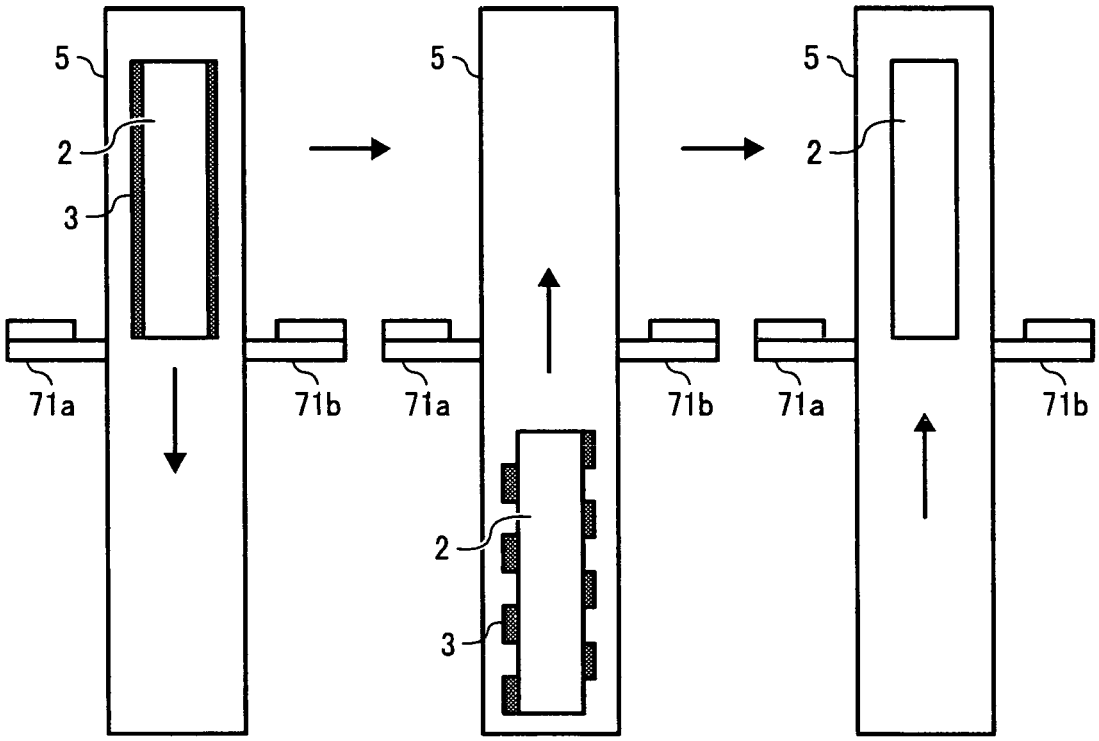
FIGS. 11A to 11C are schematic diagrams for explaining a process of cleaning a cleaning target object shown in FIG. 1.
Figure 12:
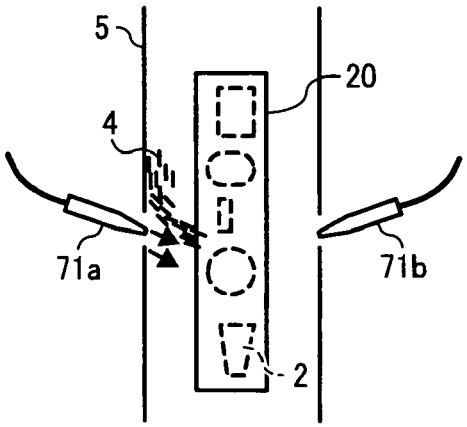
FIG. 12 is a schematic diagram for explaining collision of a cleaning medium with a cleaning target object by air output from an acceleration nozzle of a cleaning-medium accelerating unit shown in FIG. 1.

The processes of generating the circulation air, removing dust from the cleaning target object 2, and recycling the cleaning medium 4 are repeatedly performed while the cleaning target object 2 gradually moves down from the initial position. As shown in FIG. 11B, when the cleaning target object 2 reaches a turn-round position, the work moving unit 21 stops moving down the cleaning target object 2, and gradually moves up the cleaning target object 2. The controller 12 alternately performs each of the processes of generating the circulation air, removing dust from the cleaning target object 2, and recycling the cleaning medium 4 when the cleaning target object 2 is gradually moving up, removing the dust 3 from an entire surface of the cleaning target object 2. As shown in FIG. 11C, when the cleaning target object 2 reaches an upper end portion of the cleaning tank 5, i.e., the initial position, the controller 12 stops a cleaning operation. When the cleaning operation is stopped, the controller 12 opens the cover 10 of the cleaning tank 5 to discharge the cleaning target object 2 held by the work holding unit 20 from the cleaning tank 5 using the work moving unit 21. Subsequently, the cleaning target object 2 is replaced with new cleaning target object and the cleaning operation is restarted.

As described above, by intermittently operating the cleaning-medium circulating unit and the cleaning-medium accelerating unit or the cleaning-medium recycle unit, it is possible to avoid interference between each of operations of accelerating, vacuuming, and circulating the cleaning medium. Therefore, it is possible to effectively move the cleaning medium, and cause the cleaning medium to collide with the cleaning target object. As a result, cleaning performance can be improved and energy consumption can be reduced.

Although it is explained that the compressed air is alternately blown out from each of the acceleration nozzles 71*a* and 71*b* of the cleaning-medium accelerating unit 7 to clean an entire surface of the cleaning target object 2, it is possible to simultaneously blow out compressed air from each of the acceleration nozzles 71*a* and 71*b* by adjusting an angle for blowing air. When dust is attached to exclusively on one surface of the cleaning target object 2, it is sufficient to blow compressed air from one of the acceleration nozzles 71*a* and 71*b*.

By arranging the cleaning-medium accelerating unit in such a manner that generated air and circulation air generated by the circulation-air generating unit do not flow in the same plane, avoiding interference between the circulation air and the air for accelerating the cleaning medium. As a result, it is possible to realize stable cleaning performance.

Figure 13A:
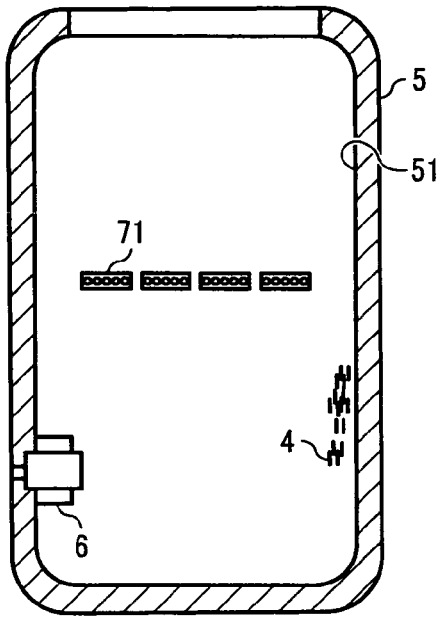
FIGS. 13A to 13D are schematic diagrams of internal surfaces with circulation paths for circulating air in the cleaning tank shown in FIG. 1.
Figure 13B:
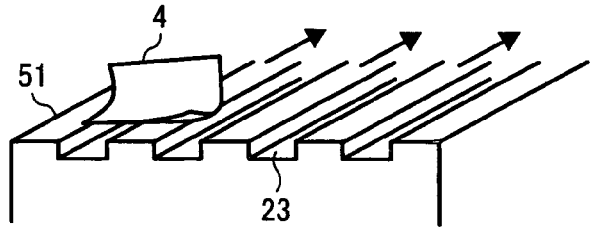

Furthermore, although it is explained that the circulation path of the circulation air generated by the circulation-air generating unit is formed on a flat surface inside the cleaning tank 5, it is possible to arrange a plurality of grooves 23 formed in a square shape or in a curved surface along a direction of flow of the circulation air, on a surface 51 constituting the circulation path in the cleaning tank 5 as shown in FIGS. 13A and 13B. It is preferable to arrange the groove 23 with a width smaller than a face size of the cleaning medium 4, so that the cleaning medium 4 hardly falls into the groove 23. By arranging the groove 23 as described above, a space is formed between the surface 51 of the cleaning tank 5 and the cleaning medium 4, so that contact resistance between the surface 51 and the cleaning medium 4 can be reduced. Furthermore, by flowing the circulation air in the groove 23, it is possible to effectively deliver the cleaning medium 4, realizing delivery of large amounts of the cleaning media 4. Moreover, because circulation air is rectified by a plurality of the grooves 23, occurrence of turbulence can be avoided, preventing degradation of air force. Therefore, it is possible to effectively deliver and flow up the cleaning medium 4, resulting in improving cleaning efficiency. A height of the groove 23 is sufficient as long as air can pass through the groove 23. For example, if the height is set in a range between 0.1 millimeter (mm) and 1 mm, the groove 23 can be easily processed.

Figure 13C:
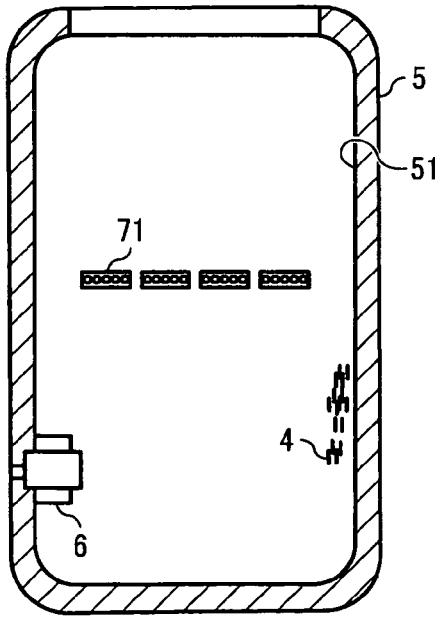
Figure 13D:
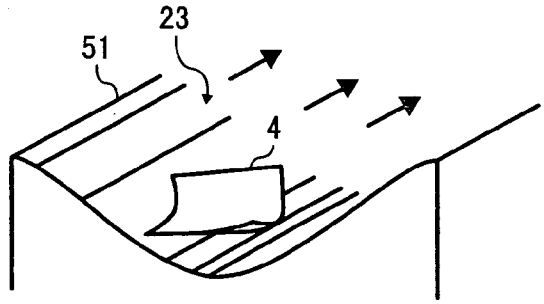

It is acceptable to form the surface 51, on which the circulation path is formed in the cleaning tank 5, on a concavely curved surface as shown in FIGS. 13C and 13D. With the surface 51 formed on the concavely curved surface, it is possible to prevent dispersion of the circulation air. Accordingly, a large amount of the cleaning media 4 can be delivered, making it possible to disperse large amounts of the cleaning media 4 in the cleaning tank 5. As a result, cleaning efficiency can be improved.

Figure 14A:
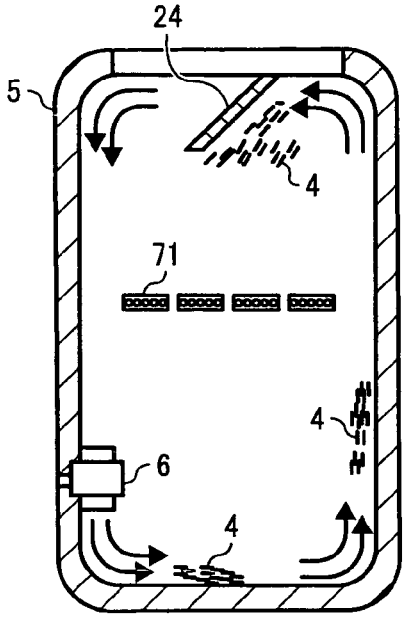
FIGS. 14A and 14B are cross sections of the cleaning tank with air rectifying unit on the circulation paths shown in FIGS. 13A to 13D.
Figure 14B:
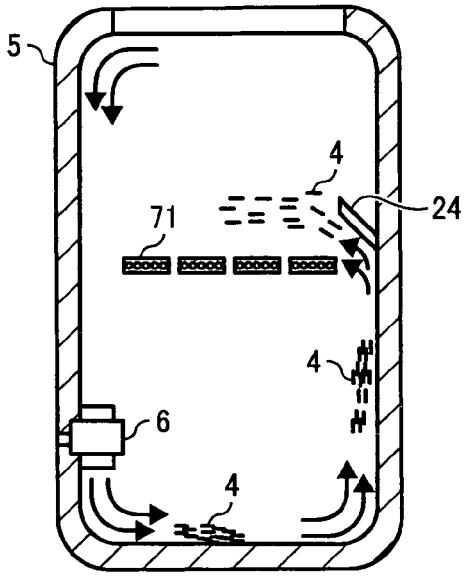

As shown in FIGS. 14A and 14B, it is preferable to arrange an air rectifying unit 24 that leads the cleaning medium 4 toward the cleaning-medium accelerating unit 7, on an upper surface or an upper portion of a side surface of the cleaning tank 5, where the circulation path is formed. By arranging the air rectifying unit 24 on the circulation path, it is possible to disperse a large amount of the cleaning media 4 between the cleaning-medium accelerating unit 7 and the cleaning target object 2, resulting in improving cleaning efficiency. Furthermore, it is possible to directly cause the cleaning medium 4, of which flowing direction is changed by the air rectifying unit 24, to collide with the cleaning target object 2 to perform cleaning. It is preferable to adjust an angle of flowing air by the air rectifying unit 24 depending on a shape or a position of the cleaning target object 2.

As described above, by arranging, in the cleaning tank, the air rectifying unit that leads the circulation air toward a path of blowing high-velocity air from the cleaning-medium accelerating unit, it is possible to assuredly cause the cleaning medium to collide with the cleaning target object even when the air flow speed for delivering the cleaning medium increases. Therefore, it is possible to reduce such a loss that the cleaning medium circulates without colliding with the cleaning target object. As a result, it is possible to effectively use the cleaning medium. Furthermore, it is possible to use kinetic energy delivered through the circulation path in addition to energy from the cleaning-medium accelerating unit to cause the cleaning medium to collide with the cleaning target object. Therefore, cleaning efficiency can be improved.

Figure 15A:
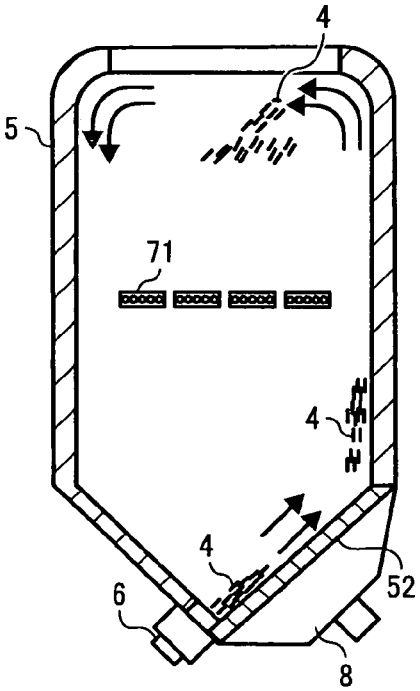
FIGS. 15A and 15B are cross sections of the cleaning tank with an inclined surface according to the first embodiment.
Figure 15B:
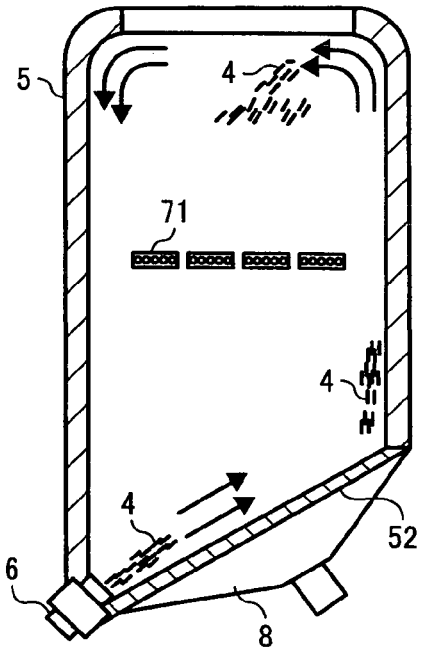

As shown in FIGS. 15A and 15B, it is possible to arrange an inclined surface 52 including an opening portion on a bottom portion of the cleaning tank 5, without forming the cleaning tank in a rectangular shape. It is possible to arrange the cleaning-medium recycle unit 8 on the inclined surface 52, the circulation-air generating unit 6 on the lower portion of the inclined surface 52, and flows the circulation air along the inclined surface from the circulation-air generating unit 6. With such configuration, when the cleaning medium 4 falls on the separation member 81 of the cleaning-medium recycle unit 8 after removing the dust from the cleaning target object 2 by a collision with the cleaning target object 2, the cleaning medium 4 can be easily collected around the outlet opening 65 of the circulation-air generating unit 6. By generating the circulation air from the circulation-air generating unit 6 to the collected cleaning medium 4, it is possible to deliver a large number of the cleaning media 4 by less amount of compressed air, realizing energy saving. Furthermore, by using the area where the cleaning-medium recycle unit 8 is arranged as an area for collecting the cleaning medium 4, it is possible to take longer time for recycling the cleaning medium 4. As a result, efficiency of recycling the cleaning medium 4 can be improved.

Figure 16:
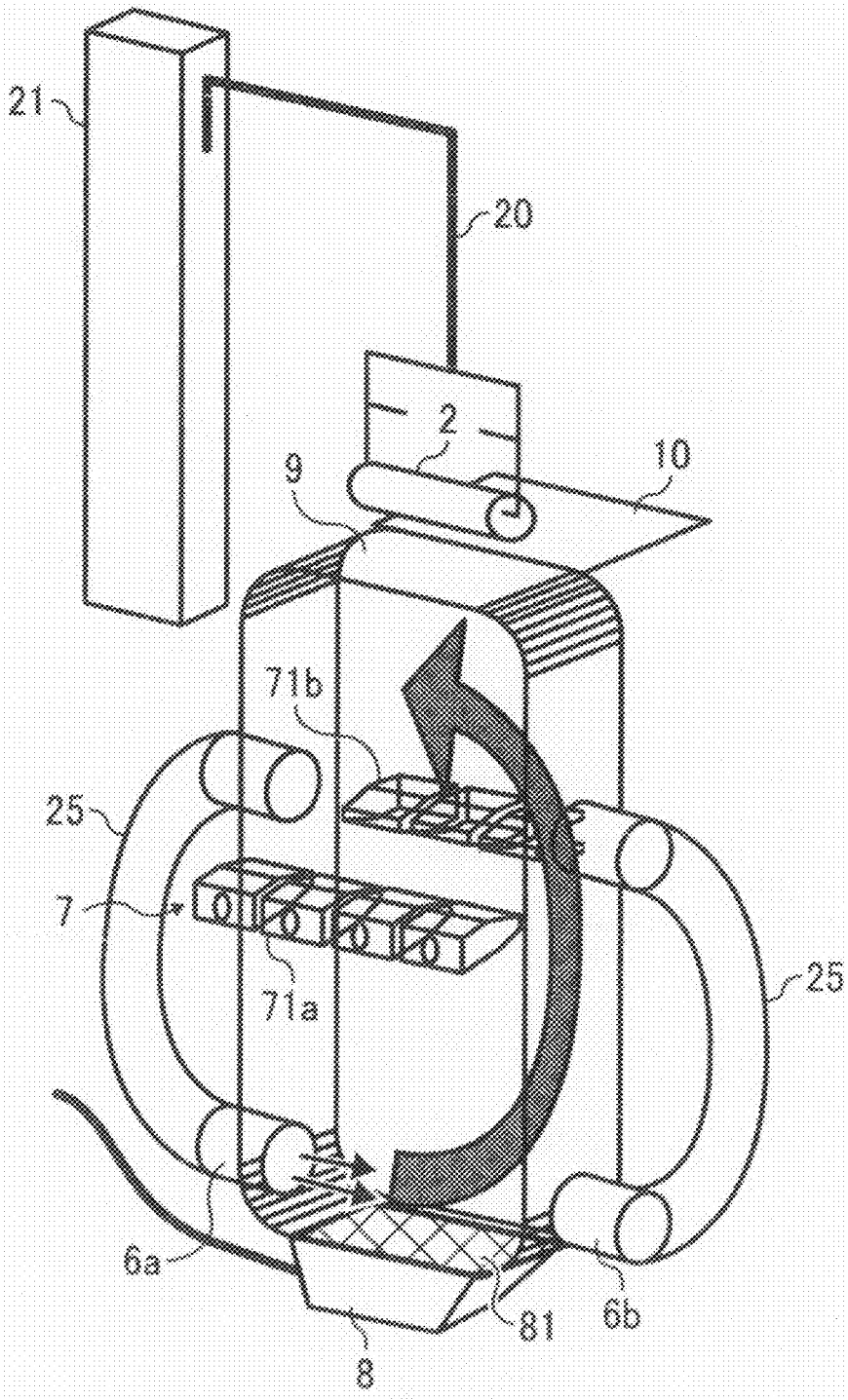
FIG. 16 is a schematic diagram of a dry cleaning device according to a second embodiment of the present invention.
Figure 17:
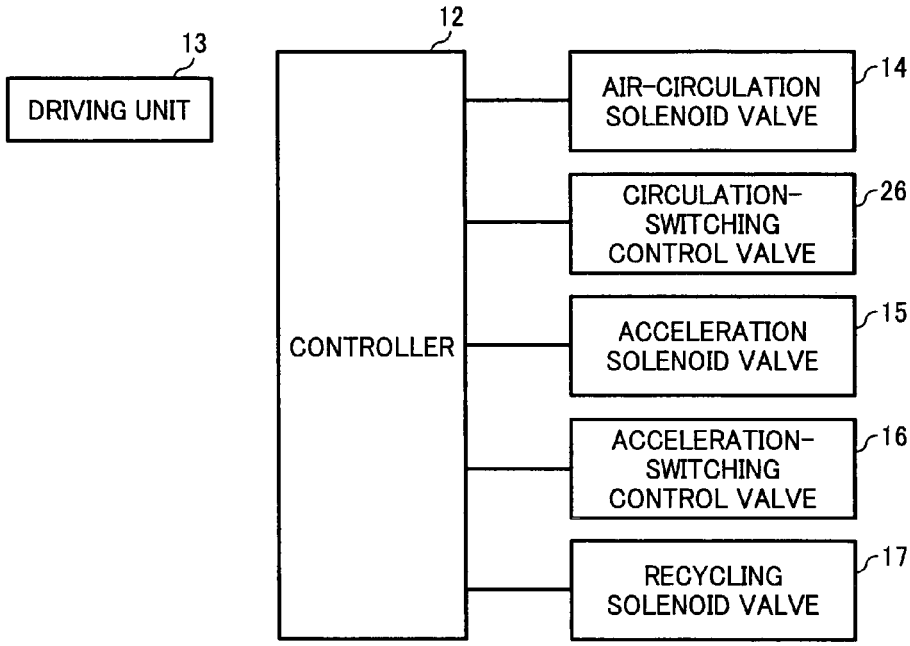
FIG. 17 is a block diagram of a drive control unit of the dry cleaning device shown in FIG. 16.
Figure 18:
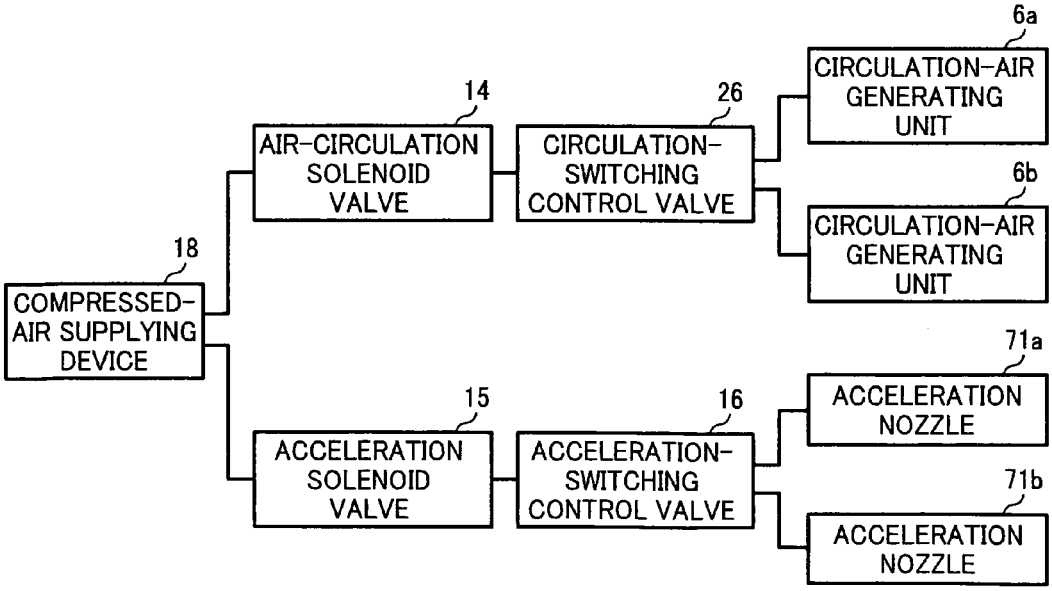
FIG. 18 is a block diagram of a driving unit of the dry cleaning device shown in FIG. 16.

It is explained in the first embodiment that the circulation-air generating unit 6 is singularly arranged in the cleaning tank 5. However, in a second embodiment of the present invention, it is possible to symmetrically arrange two circulation-air generating units 6*a* and 6*b* around each of bottom portions of side surfaces of the cleaning tank 5, in such a manner that the circulation-air generating units 6*a* and 6*b* sandwich the separation member 81 of the cleaning-medium recycle unit 8. In the example shown in FIG. 16, the circulation-air generating units 6*a* and 6*b* are arranged outside of the cleaning tank 5, the outlet opening 65 is arranged at the lower portion of the cleaning tank 5, and the inlet opening 61 is connected to an upper portion of the cleaning tank 5 via a duct hose 25. In this case, the controller 12 controls an operation of a circulation-switching control valve 26 that switches supply of compressed air to the circulation-air generating units 6*a* and 6*b* as shown in a block diagram of FIG. 18, in addition to the air-circulation solenoid valve 14, the acceleration solenoid valve 15, the acceleration-switching control valve 16, and the recycling solenoid valve 17 as shown in a block diagram of FIG. 17. When flowing the cleaning medium 4 by generating the circulation air inside the cleaning tank 5, the controller 12 controls the circulation-switching control valve 26 to alternately generate the circulation air from each of the circulation-air generating units 6*a* and 6*b*. Accordingly, the cleaning media 4 are hardly accumulated inside the cleaning tank 5. Therefore, it is possible to effectively use the cleaning medium 4 inside the cleaning tank 5, increasing possibility of collision between the cleaning medium 4 and the cleaning target object 2. As a result, cleaning efficiency can be improved.

By connecting the inlet opening 61 to the upper portion of the cleaning tank 5 via the duct hose 25, it is possible to generate ascending air current inside the cleaning tank 5. Therefore, floating duration of the cleaning medium 4 can be increased, increasing the number of the flowing cleaning medium 4. As a result, it is possible to increase the number of the cleaning media 4 that collide with the cleaning target object 2 by compressed air blown out from the acceleration nozzles 71*a* and 71*b*, improving cleaning performance. Although the inlet opening 61 is connected to the cleaning tank 5 via the duct hose 25, because the duct hose 25 is connected to the upper portion of the cleaning tank 5, where space density due to the cleaning medium 4 is small, it is possible to prevent the cleaning medium 4 from clogging the duct hose 25 or the circulation-air generating units 6*a* and 6*b*.

Figure 19:
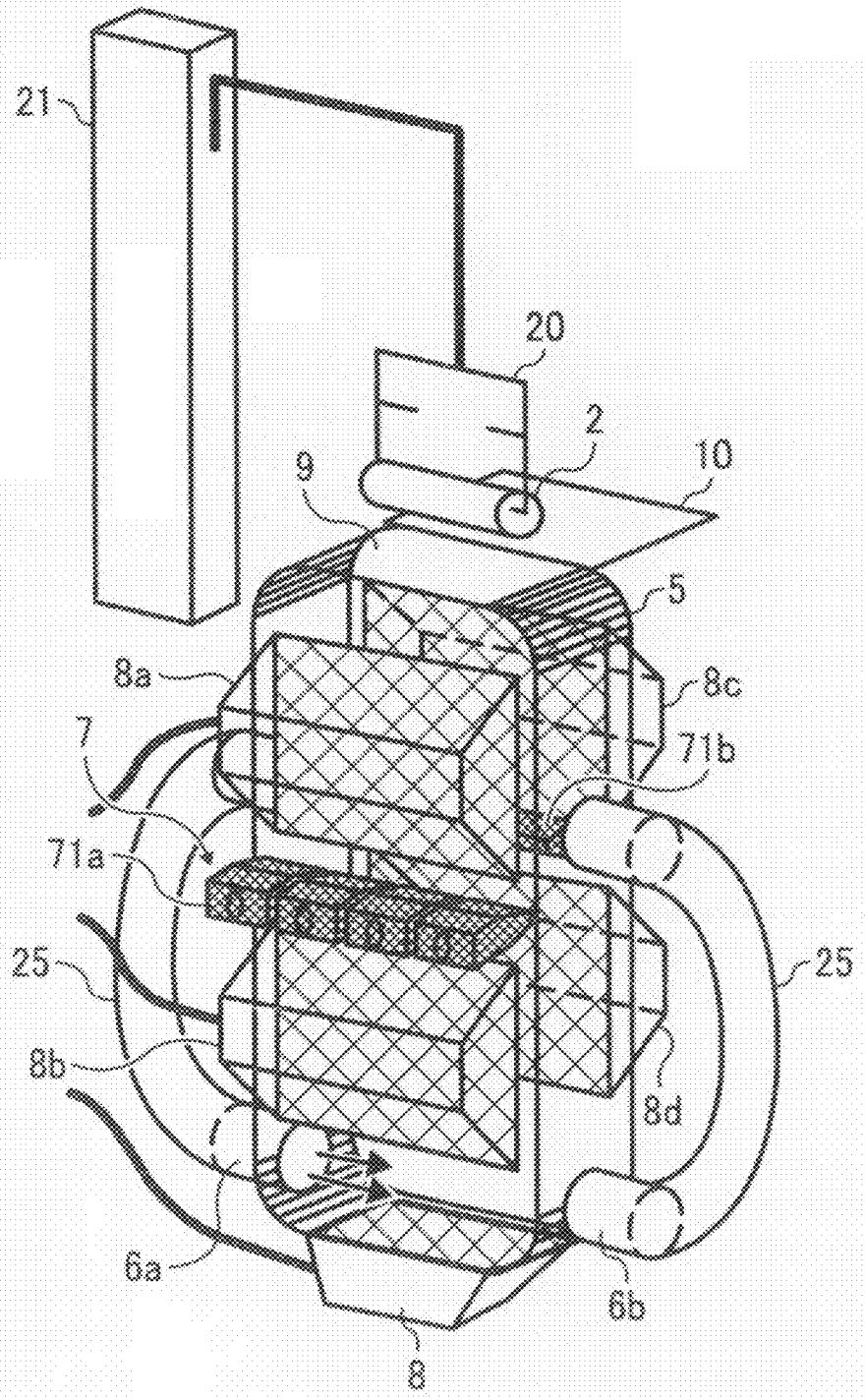
FIG. 19 is a schematic diagram of a dry cleaning device according to a third embodiment of the present invention.
Figure 20:
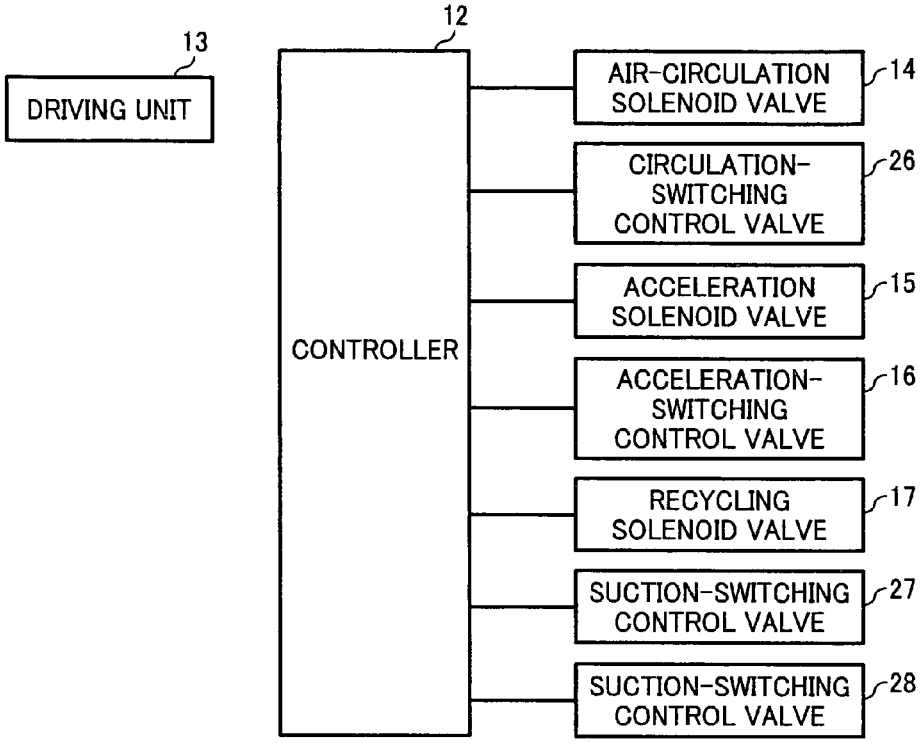
FIG. 20 is a block diagram of a drive control unit of the dry cleaning device shown in FIG. 19.
Figure 21:
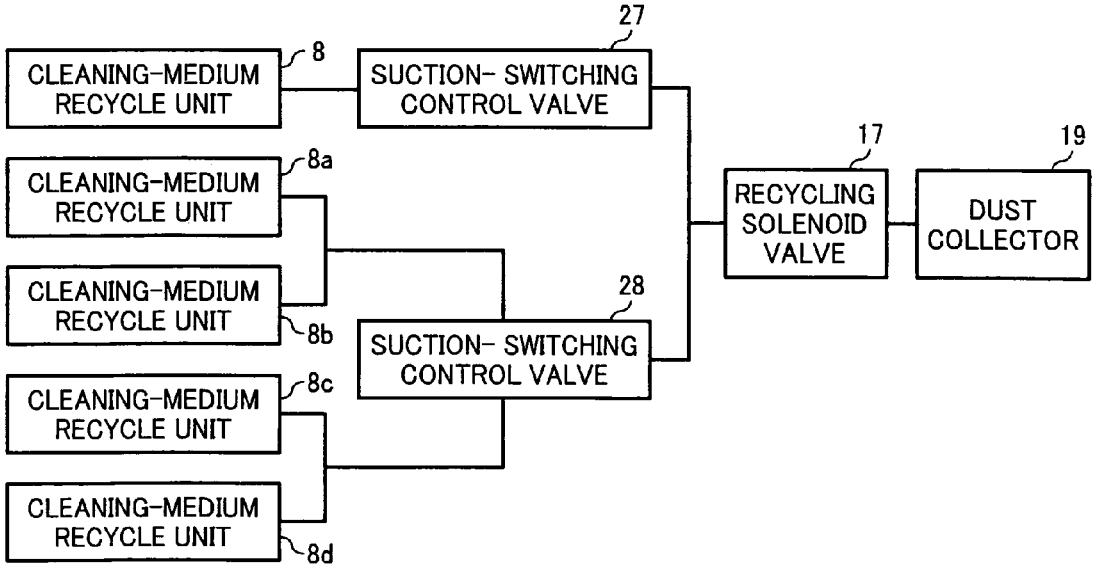
FIG. 21 is a block diagram of a driving unit of the dry cleaning device shown in FIG. 19.
Figure 22:
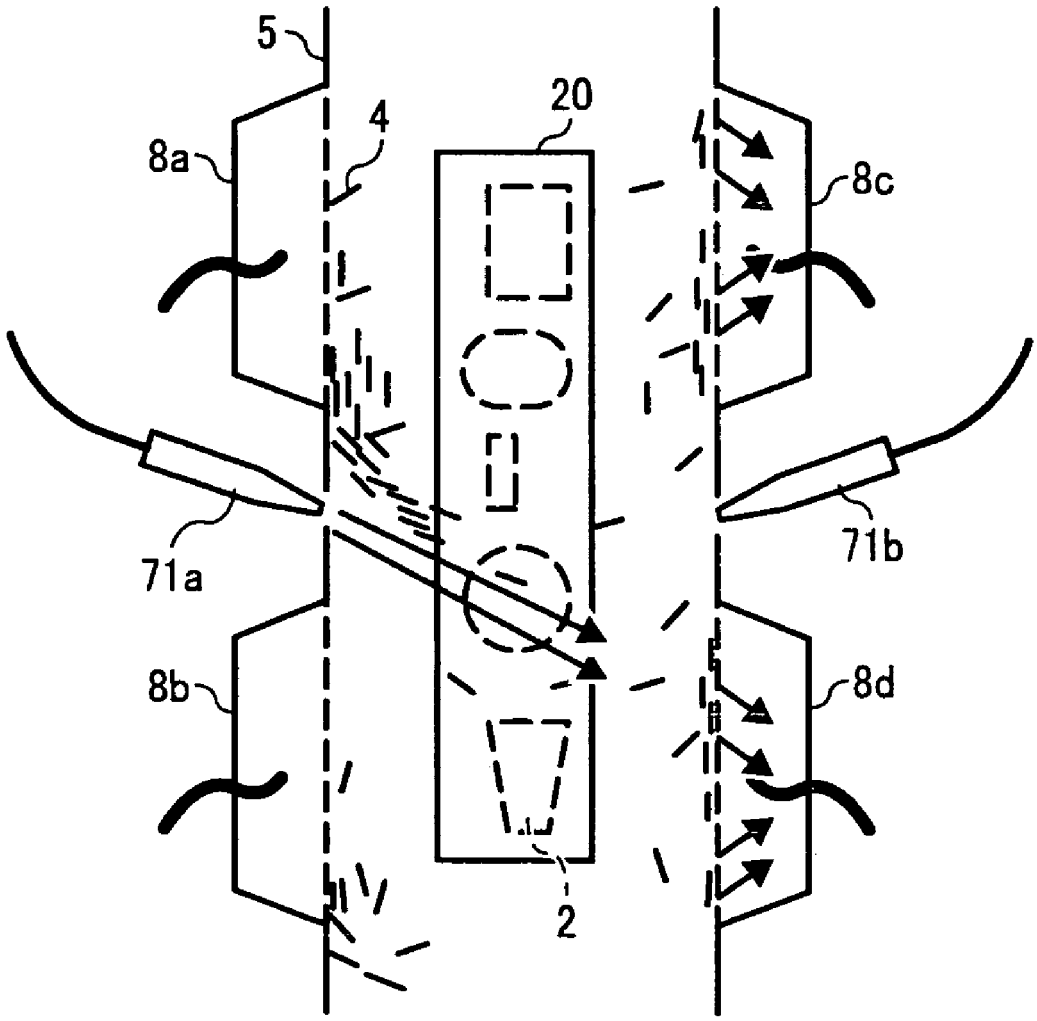
FIG. 22 is a schematic diagram for explaining a state of colliding a cleaning medium with a cleaning target object in the dry cleaning device shown in FIG. 19.

Although it is explained that the cleaning-medium recycle unit 8 is singularly arranged in the cleaning tank 5, it is possible to arrange a plurality of the cleaning-medium recycle units 8 in a third embodiment of the present invention. For example, as shown in FIG. 19, it is possible to arrange a plurality of cleaning-medium recycle units 8*a* to 8*d*, which sandwich the arrayed acceleration nozzles 71*a* and 71*b*, in addition to the cleaning-medium recycle unit 8 arranged on the bottom portion of the cleaning tank 5. In this case, the controller 12 controls operations of each of a suction-switching control valve 27 that switches a suction operation performed to the cleaning-medium recycle unit 8, and a suction-switching control valve 28 that switches a suction operation performed to each of the cleaning-medium recycle units 8*a* to 8*d* as shown in a block diagram of FIG. 21, in addition to the air-circulation solenoid valve 14, the acceleration solenoid valve 15, the acceleration-switching control valve 16, the recycling solenoid valve 17, and the circulation-switching control valve 26 as shown in a block diagram of FIG. 20. As shown in FIG. 22, when cleaning the cleaning target object 2 by blowing compressed air from the acceleration nozzle 71*a* arranged on a front surface of the cleaning tank 5, the controller 12 connects the suction-switching control valve 28 to the cleaning-medium recycle unit 8, and connects the suction-switching control valve 28 to the cleaning-medium recycle units 8*c* and 8.*d* arranged on a back surface of the cleaning tank 5. On the other hand, when cleaning the cleaning target object 2 by blowing compressed air from the acceleration nozzle 71*b* arranged on the back surface of the cleaning tank 5, the controller 12 connects the suction-switching control valve 28 to the cleaning-medium recycle units 8*a* and 8*b* arranged on the front surface of the cleaning tank 5. In this manner, the dust 3 and the cleaning medium 4 flown up by the compressed air blown from the acceleration nozzle 71*a* are stuck to the cleaning-medium recycle units 8*c* and 8*d*. When the dust 3 and the cleaning medium 4 are stuck to the cleaning-medium recycle units 8*c* and 8*d*, air-flow from the acceleration nozzle 71*a* acts on the dust 3 and the cleaning medium 4, in addition to suction air from the cleaning-medium recycle units 8*c* and 8*d*. Therefore, it is possible to largely increase flow speed at a mesh portion of the separation member 81 of each of the cleaning-medium recycle units 8*c* and 8*d*, improving performance of removing the dust 3 attached to the cleaning medium 4. As a result, the cleaning medium 4 can be assuredly recycled. When blowing of the compressed air from the acceleration nozzle 71*a* is stopped, the cleaning-medium recycle units 8*c* and 8*d* terminates a suction operation after a predetermined time elapsed. Therefore, it is possible to assuredly remove, from the cleaning-medium recycle units 8*c* and 8*b*, the cleaning medium stuck to the cleaning-medium recycle units 8*c* and 8*b*.

As described above, by alternately switching an operation of recycling the cleaning medium performed by each of the cleaning-medium recycle units, action for sucking the cleaning medium is continuously performed in one of the cleaning-medium recycle units in the cleaning tank. As a result, it is possible to maintain recyclability of the cleaning medium and negative pressure inside the cleaning tank.

It is possible to prevent unwanted situation in which the flown cleaning medium 4 falls down without being accelerated by the acceleration nozzles 71*a* and 71*b*. Furthermore, it is possible to supply large amounts of the cleaning media 4 between the acceleration nozzles 71*a*, 71*b*, and the cleaning target object 2 when the acceleration nozzles 71*a* and 71*b* blow out compressed air. As a result, cleaning efficiency can be improved. In other words, when cleaning the cleaning target object 2 by colliding the flaked-shaped cleaning target 4 with the cleaning target object 2, quality in cleaning is substantially proportional to frequency of collision of the cleaning medium 4 with the cleaning target object 2 at a predetermined speed or faster. Therefore, if supply amount of the cleaning media 4 increases, quality in cleaning is improved, resulting in reducing cleaning time and energy consumption.

Figure 23:
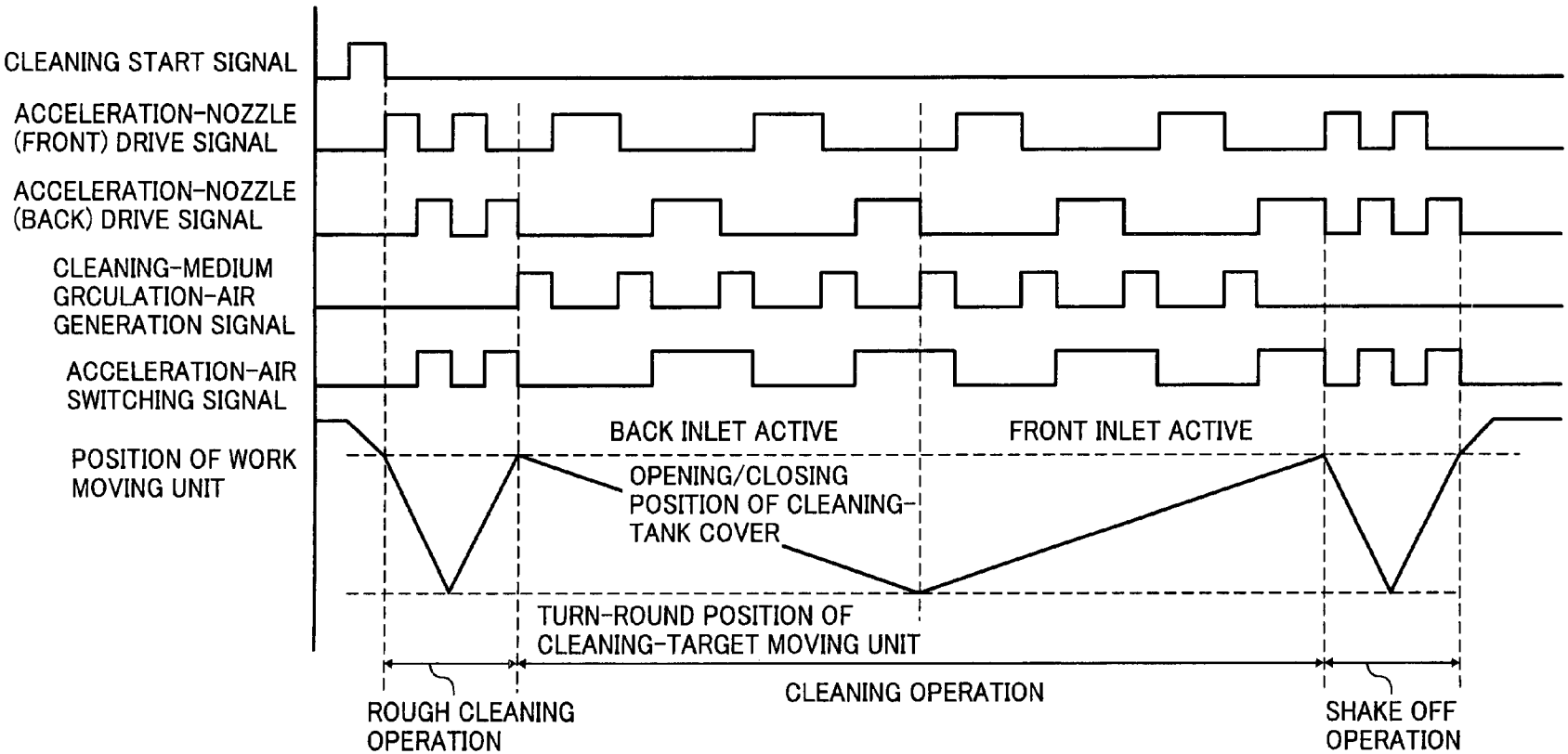
FIG. 23 is a timechart of a cleaning operation including a rough cleaning and a shake-off operation according to the third embodiment.

It is possible to clean the cleaning target object 2 using the cleaning medium 4 after performing rough cleaning using the acceleration nozzles 71*a*, 71*b*, and the cleaning-medium recycle units 8*a* to 8*b*. An operation of performing the rough cleaning is explained with reference to a timechart shown in FIG. 23.

The flaked-shaped cleaning medium 4 is introduced into the cleaning tank 5 and accumulated on the separation member 81 of the cleaning-medium recycle unit 8. Subsequently, the cleaning target object 2 held by the work holding unit 20 is loaded from the cleaning-target loading port 9 by the work moving unit 21, and set at an initial position. The cover 10 is closed to seal off the cleaning tank 5. Upon receiving a cleaning start signal by an operation of the driving unit 13, the controller 12 opens the acceleration solenoid valve 15 to switch the acceleration-switching control valve 16 at a predetermined interval, so that each of the acceleration nozzles 71*a* and 71*b* alternately blows compressed air. The controller 12 switches the acceleration-switching control valve 16 in synchronization with switching of blowing compressed air from each of the acceleration nozzles 71*a* and 71*b*, to switch adsorption performed by each pair of the cleaning-medium recycle units 8*a*, 8*b*, and 8*c*, 8*d*, arranged on surfaces facing each of the acceleration nozzles 71*a* and 71*b*. In other words, when the acceleration nozzle 71*a* arranged on the front surface of the cleaning tank 5 blows compressed air, the cleaning-medium recycle units 8*c* and 8*d* arranged on the back surface of the cleaning tank 5 performs suction operation. With this operation, the compressed air blown out from the acceleration nozzle 71*a* collides with the cleaning target object 2, so that a large part of the dust 3 or weakly-attached stain on the cleaning target object 2 are removed, completing rough cleaning of the cleaning target object 2. Subsequently, the circulation-air generating unit 6 generates circulation air to deliver and flow up the cleaning medium 4 accumulated on the separation member 81 of the cleaning-medium recycle unit 8, and the cleaning target object 2 is cleaned using the flowing cleaning medium 4. After the cleaning by the flowing cleaning medium 4 is finished, each of the acceleration nozzles 71*a* and 71*b* alternately blows compressed air, so that the controller 12 switches the acceleration-switching control valve 16 in synchronization with switching of blowing compressed air from each of the acceleration nozzles 71*a* and 71*b*. Accordingly, suction performed by each pair of the cleaning-medium recycle units 8*a*, 8*b*, and 8*c*, 8*d*, which are arranged on surfaces respectively facing the acceleration nozzles 71*a* and 71*b*, can be switched from one another. Subsequently, the controller 12 shakes off the cleaning medium 4 attached by static electricity to the cleaning target object 2, and terminates a cleaning operation. Thereafter, the controller 12 opens the cover 10 of the cleaning tank 5 to take off the cleaning target object 2 from the cleaning tank 5 by the work moving unit 21, and replaces the cleaning target object with a new cleaning target object to restart the cleaning operation. By performing shake off cleaning of the cleaning medium 4 as described above, it is possible to increase cleaning speed and improve cleaning quality.

Figure 24A:
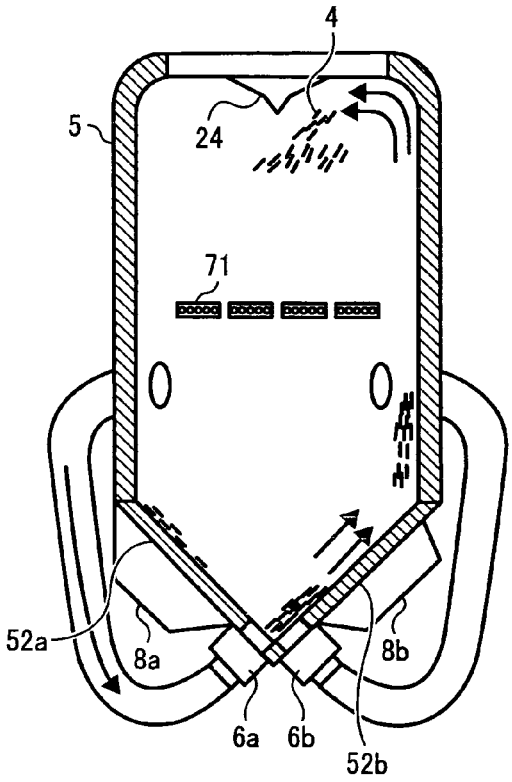
FIGS. 24A and 24B are schematic diagrams of a dry cleaning device according to a fourth embodiment of the present invention.
Figure 24B:
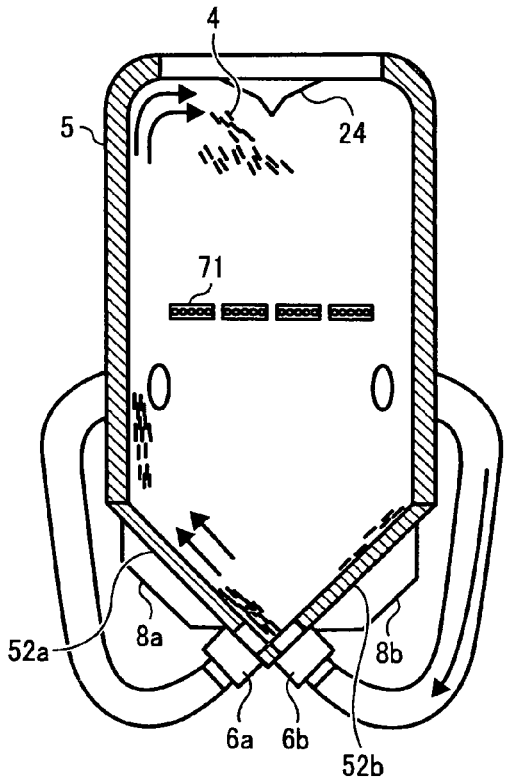

Although it is explained that the cleaning-medium recycle units 8*a* to 8*d* are arranged on the front and the back surfaces of the cleaning tank 5, it is possible to arrange differently. In a forth embodiment of the present invention, as shown in FIGS. 24A and 24B, inclined surfaces 52*a* and 52*b* including respective openings, which make V-shaped bottom portion of the cleaning tank 5, are arranged on a bottom portion of the cleaning tank 5, the cleaning-medium recycle units 8 is arranged on each of the inclined surfaces 52*a* and 52*b*, the circulation-air generating units 6*a* and 6*b* are arranged at respective lower end portions of the inclined surfaces 52*a* and 52*b*, and the circulation air flows alternately from each of the circulation-air generating units 6*a* and 6*b* along the inclined surfaces 52*a* and 52*b*. In this case, it is preferable to arrange the air rectifying unit 24 that leads the cleaning medium 4 toward the cleaning-medium accelerating unit 7, on a top surface or a top portion of a side surface of the cleaning tank 5 constituting the circulation path of the circulation air.

As described above, with a configuration in which a V-shaped inclined surfaces including the cleaning-medium recycle unit are arranged at the bottom portion of the cleaning tank, the circulation-air generating unit that generates circulation air along each of the inclined surfaces is arranged on the lower end portion of each of the inclined surfaces, and each of the circulation-air generating unit arranged on each of the lower end portions of the inclined surfaces are alternately operated, the cleaning medium can be collected at one area on the circulation path. Furthermore, the circulation air is intermittently generated along the internal surfaces of the cleaning tank to circulate the collected cleaning medium along the internal surfaces of the cleaning tank. Thus, it is possible to deliver a large amount of the cleaning media at one time with less amounts of air. As a result, energy saving can be realized and cleaning efficiency can be improved.

Figure 25:
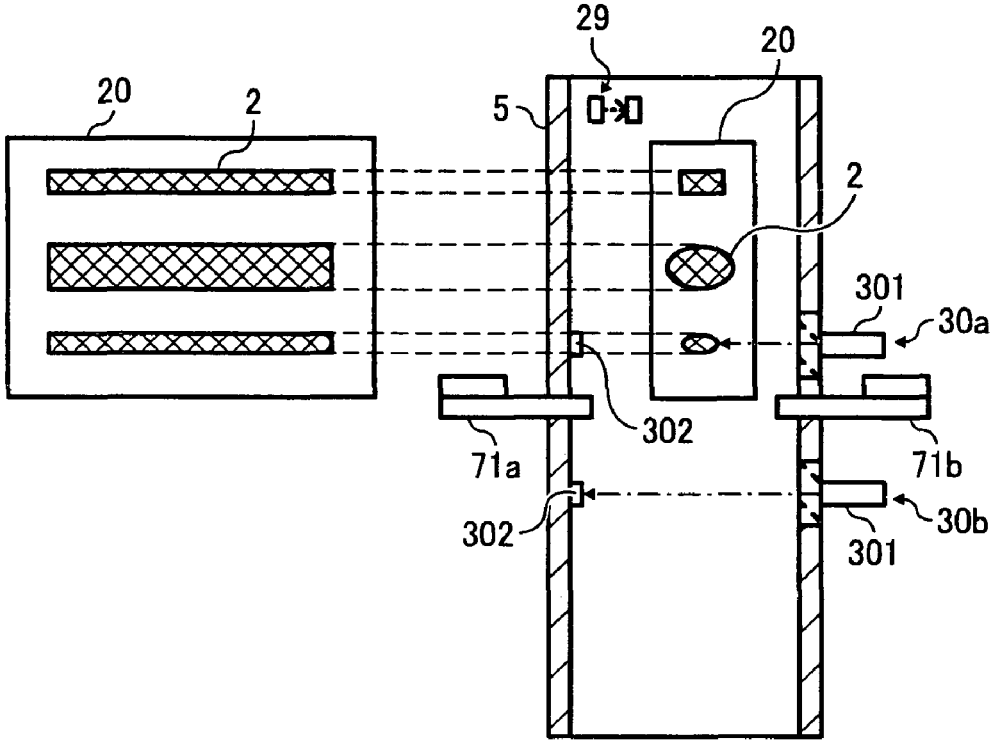
FIG. 25 is a schematic diagram of a dry cleaning device including a medium-amount measuring unit and a cleaning-target detecting unit according to a fifth embodiment of the present invention.
Figure 26:
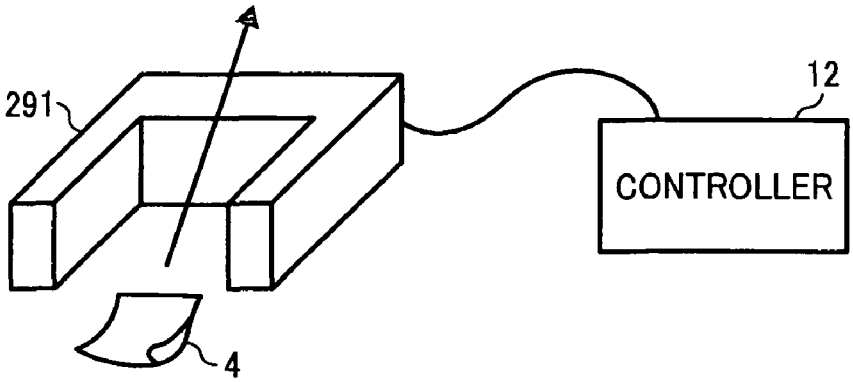
FIG. 26 is a schematic diagram of a photoelectronic sensor constituting the medium-amount measuring unit shown in FIG. 25.
Figure 27:
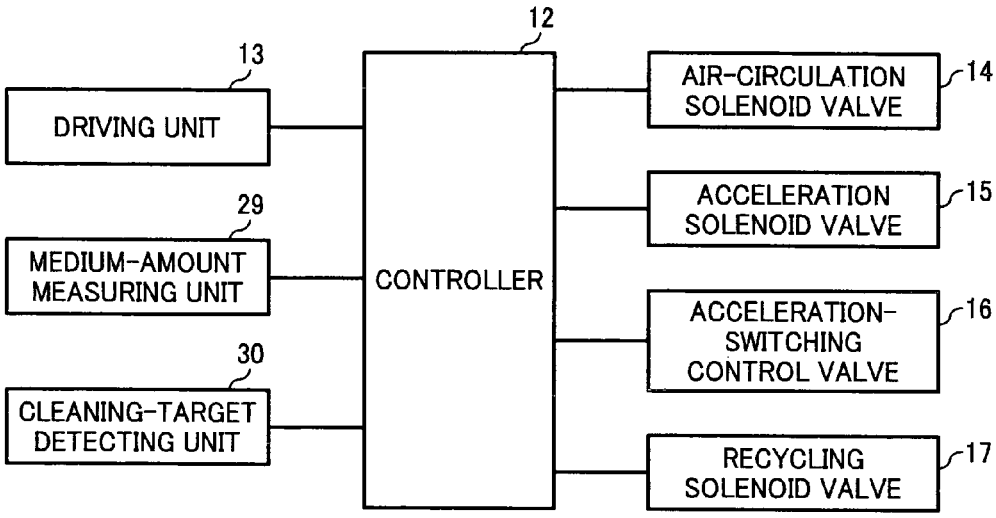
FIG. 27 is a block diagram of a drive control unit of the dry cleaning device shown in FIG. 25.

When the cleaning media 4 are flown up to clean the cleaning target object 2 by colliding with the cleaning target object 2, part of the cleaning media 4 are discharged to the dust collector 19 through the mesh portion included in the separation member 81 of the cleaning-medium recycle unit 8. Accordingly, the number of the cleaning media 4 in the cleaning tank 5 decreases during cleaning. When amount of the flowing cleaning medium 4 decreases in the cleaning tank 5 due to a decrease of the number of the cleaning media 4 in the cleaning tank 5, cleaning effect decreases. In some cases, a plurality of the cleaning target objects 2 held by the work holding unit 20 are loaded into the cleaning tank 5 for cleaning. In this case, it is preferable to arrange a medium-amount measuring unit 29 inside the cleaning tank 5, and arrange cleaning-target detecting units 30*a* and 30*b* sandwiching the acceleration nozzles 71*a* and 71*b* with a predetermined interval, as shown in FIG. 25. This configuration is described below as a fifth embodiment of the present invention. The medium-amount measuring unit 29 is constituted of a photoelectronic sensor 291 arranged in such a manner that an optical axis of the photoelectronic sensor 291 becomes orthogonal to a direction of circulation of the cleaning medium 4 as shown in FIG. 26. The cleaning-target detecting units 30*a* and 30*b* are constituted of a photoelectronic sensor including a light projecting/receiving unit 301 and a reflecting plate 302. The light projecting/receiving unit 301 is attached to either the front surface or the back surface of the cleaning tank 5 via a transparent window for preventing interference with the cleaning medium 4. The reflecting plate 302 is attached to an internal surface that faces the light projecting/receiving unit 301, and arranged in such a manner that its optical axis crosses the cleaning tank 5 in a longitudinal direction. The medium-amount measuring unit 29, and the cleaning-target detecting units 30*a*, 30*b* are connected to the controller 12 as shown in FIG. 27. The controller 12 measures how many times the optical axis of the photoelectronic sensor 291 as the medium-amount measuring unit 29 is blocked, quantifies amounts of the flowing cleaning medium 4 during a predetermined time period, and controls the cleaning operation when one of the cleaning-target detecting units 30*a* and 30*b* detects the cleaning target object 2.

Figure 28:
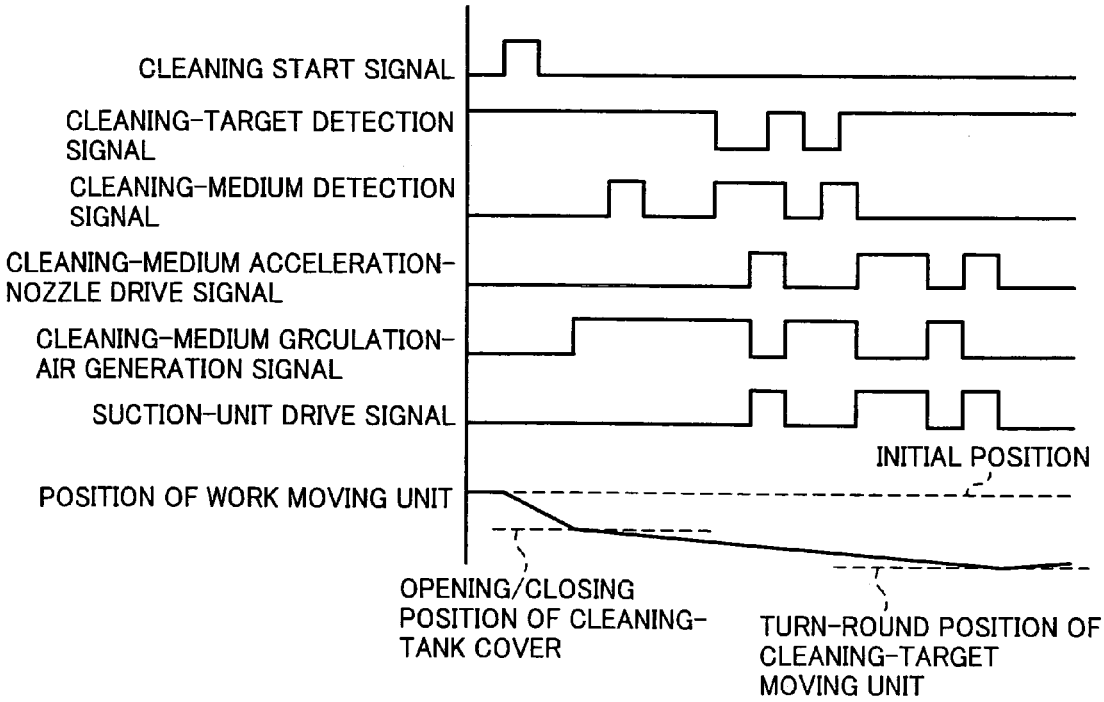
FIG. 28 is a timechart of an operation performed by the dry cleaning device shown in FIG. 25.

The cleaning operation performed by a cleaning device in which the medium-amount measuring unit 29, and the cleaning-target detecting units 30*a*, 30*b* are arranged in the cleaning tank 5 is described with reference to a timechart shown in FIG. 28.

After a plurality of the cleaning target objects 2 held by the work holding unit 20 are loaded into the cleaning tank 5 as shown in FIG. 25, and when receiving a cleaning start signal, the circulation-air generating unit 6 generates circulation air for delivering the cleaning medium 4 accumulated on the cleaning-medium recycle unit 8 and flowing up the cleaning medium 4 inside the cleaning tank 5. The photoelectronic sensor 291 as the medium-amount measuring unit 29 detects the amount of the flowing cleaning medium 4 and inputs measured amount to the controller 12. The controller 12 compares input amount of the flowing cleaning medium 4 in a predetermined time period with a predetermined threshold. When the amount of the flowing cleaning medium 4 exceeds the threshold, the controller 12 starts a cleaning operation. When the amount of the flowing cleaning medium 4 is equal to or smaller the threshold, the controller 12 issues a warning indicating scarcity of the cleaning medium 4, and terminates the cleaning operation. Subsequently, when the cleaning medium 4 with a predetermined amount or an amount corresponding to the scarcity is supplied from a hopper or the like. When the cleaning medium 4 is flown up in response to the reception of the cleaning start signal, and the amount of the flowing cleaning medium 4 exceeds the threshold, the controller 12 restarts the cleaning operation.

As described above, because the amount of the flowing cleaning medium 4 is detected and cleaning is performed using the cleaning medium 4 with a predetermined amount or larger, it is possible to perform cleaning in desired quality. The amount of the cleaning medium 4 that collides with the cleaning target object 2 is proportional to the amount of the flowing cleaning medium 4. Therefore, it is possible for the controller 12 to determine cleaning quality from the amount of the flowing cleaning medium 4 for each predetermined time period. Furthermore, it is possible to assuredly quantify the cleaning quality and cleaning performance by recording variation of the amount of the flowing cleaning medium 4.

Upon starting a cleaning operation, a plurality of the cleaning target objects 2 held by the work holding unit 20 is moved up and down by the work moving unit 21. When the first cleaning target object 2 reaches a position where the optical axis of a cleaning-target detecting unit 29*a* arranged on the acceleration nozzles 71*a* and 71*b* is blocked by the cleaning target object 2, and a cleaning-target detection signal is input from the cleaning-target detecting unit 29*a* to the controller 12, the controller 12 determines a timing of performing an operation of blowing compressed air from the acceleration nozzle 71*a* and a suction operation by the cleaning-medium recycle unit 8. The timing is determined to include a delayed time taken by the cleaning target object 2 to reach a position of the acceleration nozzles 71*a* and 71*b* based on a moving speed of the cleaning target object 2 and a distance between the cleaning-target detecting unit 30*a* and the acceleration nozzles 71*a* and 71*b*. Subsequently, the controller 12 stops flowing circulation air at the timing, blows compressed air from the acceleration nozzle 71*a*, and cleans the first cleaning target object 2 by causing the cleaning-medium recycle unit 8 to start the suction operation. When input of the cleaning-target detection signal from the cleaning-target detecting unit 30*a* is stopped, the controller 12 terminates the operation of blowing the compressed air from the acceleration nozzle 71*a* and the suction operation of the cleaning-medium recycle unit 8, at a timing including a delayed time taken by the cleaning target object 2 to reach a position of the acceleration nozzles 71*a* and 71*b*, which is obtained from a moving speed of the cleaning target object 2 and a distance between the cleaning-target detecting unit 30*a* and the acceleration nozzles 71*a* and 71*b*. Subsequently, the controller 12 causes the circulation-air generating unit 6 to generate circulation air. The controller 12 repeats the above control operation every time the cleaning-target detection signal is input from the cleaning-target detecting unit 30*a*, and sequentially cleans each of the cleaning target objects 2. When the cleaning target object 2 reaches a turn-round position and starts moving up, the controller 12 repeats the above control operation every time the cleaning-target detection signal is input from the cleaning-target detecting unit 30*b* arranged under the acceleration nozzles 71*a* and 71*b* to blow compressed air from the acceleration nozzle 71*b*. Accordingly, the entire surfaces of the cleaning target objects 2 can be cleaned.

As described above, because compressed air is blown from the acceleration nozzles 71*a* and 71*b* that consume large amounts of compressed air depending on a position of the cleaning target object 2, it is possible to reduce usage of the compressed air, realizing energy consumption.

Although it is explained that the photoelectronic sensor 291 is used as the medium-amount measuring unit 29, it is possible to employ a method of accumulating impact force of the cleaning medium 4 to the cleaning target object 2 by a force sensor, weight measurement at a time of termination of a process by a weight sensor, or a method of measuring accumulation amount at a bottom portion of the cleaning tank 5 by a distance sensor or the like. When accumulating the impact force of the cleaning medium 4, it is possible to determine a cleaning quality from the number of accumulated impact.

Figure 29:
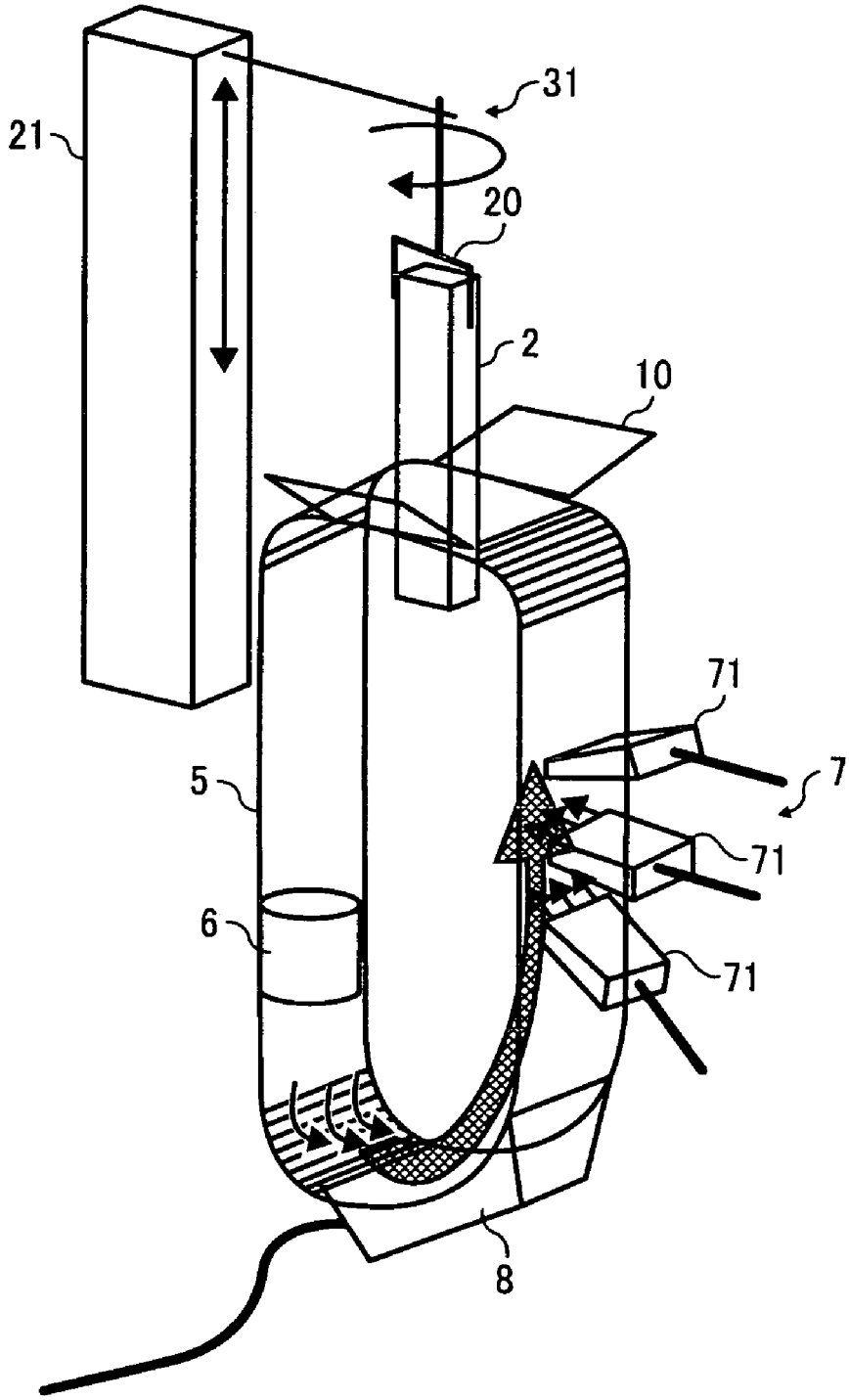
FIG. 29 is a schematic diagram of a dry cleaning device according to a sixth embodiment of the present invention.

In a sixth embodiment of the present invention shown in FIG. 29, it is possible to include a work-position changing unit 31 that rotates the work holding unit 20 in a direction of rotation of an axis in a longitudinal direction by a motor or an air cylinder, between the work moving unit 21 and the work holding unit 20. In addition, it is possible to arrange a plurality of pairs, e.g., three pairs, of the arrayed acceleration nozzles 71 as the cleaning-medium accelerating unit 7 on a side surface of the cleaning tank 5, which constitutes circulation path, in such a manner that a direction of blow of air from each of the acceleration nozzle 71 differs from one another, e.g., horizontal direction and vertical direction. The cleaning target object 2 held by the work holding unit 20 and loaded into the cleaning tank 5 is rotated by the work-position changing unit 31 to move up and down in the cleaning tank 5, and cleaned by alternately blowing compressed air from a plurality of pairs of the acceleration nozzles 71. As described above, the cleaning target object 2 is rotated when moving up and down, and compressed air is blown to the cleaning target object 2 from each different direction. Therefore, it is possible to assuredly clean an entire surface of the cleaning target object 2 even when the cleaning target object 2 is in a complicated shape.

According to an aspect of the present invention, the circulation-air generating unit directly generates circulation air that flows along an internal surface of the cleaning tank, generated circulation air is applied to the cleaning medium from a direction orthogonal to a direction of a face of the cleaning medium accumulated in the cleaning tank, so that the cleaning medium is delivered and flown up. Accordingly, it is possible to apply effective force for flowing the accumulated cleaning medium by the circulation air, resulting in flowing large number of the cleaning media and increasing frequency of collision of the cleaning medium with the cleaning target object. As a result, it is possible to realize desired quality in cleaning.

According to another aspect of the present invention, the cleaning-medium recycle unit removes attachment on the cleaning medium by suction. Therefore, cleanness of the cleaning medium can be maintained, maintaining desired quality in cleaning. Furthermore, the cleaning medium can be repeatedly used, realizing to perform a cleaning with low environmental burdens.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A dry cleaning device comprising:

a cleaning tank containing flexible flaked-shaped cleaning medium;

a circulation-air generating unit that generates high-velocity air inside the cleaning tank to cause the flexible flaked-shaped cleaning medium to flow in the cleaning tank;

a cleaning-medium accelerating unit separate from the circulation-air generating unit that accelerates the cleaning medium flowing in the cleaning tank so that the cleaning medium collides with a cleaning target object thereby separating particles sticking onto the cleaning target object; and a cleaning-medium recycle unit that sucks the particles separated from the cleaning target object and recycles the cleaning medium, wherein the cleaning-medium accelerating unit is arranged on a surface of the cleaning tank, the surface being a surface orthogonal to another surface on which a circulation path is arranged, wherein the circulation path is a path along which the air generated by the circulation-air generating unit flows.

2. The dry cleaning device according to claim 1, wherein the circulation-air generating unit generates circulation air that flows along an inner surface of the cleaning tank.

3. The dry cleaning device according to claim 1, wherein the circulation-air generating unit generates circulation air that flows along the cleaning-medium recycle unit.

4. The dry cleaning device according to claim 1, wherein the circulation-air generating unit generates circulation air that flows along a longitudinal direction of the cleaning tank.

5. The dry cleaning device according to claim 1, wherein the circulation-air generating unit includes a cylindrical inlet member having a first inlet opening and a first outlet opening, the first inlet opening being larger in size than the first outlet opening, and the first outlet opening being larger in size than the cleaning medium; and a cylindrical outlet member having a second inlet opening, an air inlet opening, and a second outlet opening, the second inlet opening being larger in size than the first outlet opening and arranged around the first outlet opening, and the air inlet opening being arranged near the second inlet opening, wherein high-velocity air is passed into the cylindrical outlet member from the air inlet opening whereby the cleaning medium enters into the cylindrical inlet member from the first inlet opening, then enters into the cylindrical outlet member from the first outlet opening and the second inlet opening, and finally goes out of the cylindrical outlet member from the second outlet opening.

6. The dry cleaning device according to claim 5, wherein the first inlet opening is arranged at a higher position than a position of the outlet opening in the cleaning tank.

7. The dry cleaning device according to claim 1, wherein the circulation-air generating unit is provided in plurality, and the dry cleaning device further comprising a controller that switches an operation of generating circulation air for each of the circulation-air generating units.

8. The dry cleaning device according to claim 1, further comprising a controller that intermittently drives at least two from among the circulation-air generating unit, the cleaning-medium accelerating unit, and the cleaning-medium recycle unit.

9. The dry cleaning device according to claim 1, wherein the cleaning-medium accelerating unit includes a nozzle embedded in a surface of the cleaning tank.

10. The dry cleaning device according to claim 1, wherein the cleaning-medium recycle unit is arranged on a bottom portion of the cleaning tank.

11. The dry cleaning device according to claim 1, wherein the cleaning-medium recycle unit is provided in plurality, and the cleaning-medium recycle units are arranged on a bottom portion of the cleaning tank at positions facing the cleaning-medium accelerating unit.

12. The dry cleaning device according to claim 11, further comprising a controller that alternately switches operations of recycling the cleaning medium respectively performed by the cleaning-medium recycle units.

13. The dry cleaning device according to claim 1, wherein a plurality of grooves are arranged on a surface of the cleaning tank along a direction of flow of the circulation air, the surface being a surface along which the circulation air flows.

14. The dry cleaning device according to claim 1, wherein a curved surface in concaved shaped is arranged on a surface of the cleaning tank along a direction of flow of the circulation air, the surface being a surface along which the circulation air flows.

15. The dry cleaning device according to claim 1, further comprising an inclined surface arranged on a bottom portion of the cleaning tank, wherein the cleaning-medium recycle unit is arranged on the inclined surface, and the circulation-air generating unit generates circulation air that flows along the inclined surface and is arranged on a lower end portion of the inclined surface.

16. The dry cleaning device according to claim 1, further comprising a V-shaped inclined surface arranged inside the cleaning tank on a bottom portion of the cleaning tank, wherein the cleaning-medium recycle unit is arranged on each of side surfaces of the V-shaped inclined surface, and the circulation-air generating unit generates circulation air that flows along each of the side surfaces of the V-shaped inclined surface and is arranged on a lower end portion of each of the side surfaces of the V-shaped inclined surface.

17. The dry cleaning device according to claim 1, further comprising an air rectifying unit arranged in the cleaning tank, wherein the air rectifying unit leads the circulation air to a path of blowing high-velocity air from the cleaning-medium accelerating unit.

18. The dry cleaning device according to claim 1, further comprising:

a medium-amount measuring unit that detects amount of the cleaning media flowing in the cleaning tank; and a controller that compares the flowing amount measured by the medium-amount measuring unit with a predetermined threshold, and when the flowing amount is equal to or lower than the threshold, issues a warning.

19. The dry cleaning device according to claim 1, further comprising:

a cleaning-target detecting unit that detects the cleaning target object in the cleaning tank, and outputs a signal indicative of a detection of the cleaning target object; and a controller that operates the circulation-air generating unit, the cleaning-medium accelerating unit, and the cleaning-medium recycle unit in synchronization with the signal.

* * * * *